US010835086B2

(12) United States Patent
Osborne, Jr.

(10) Patent No.: US 10,835,086 B2
(45) Date of Patent: Nov. 17, 2020

(54) SHEET MATERIAL TRANSFER SYSTEM/ASSEMBLY FOR A DISPENSER

(71) Applicant: Charles A. Osborne, Jr., Cumming, GA (US)

(72) Inventor: Charles A. Osborne, Jr., Cumming, GA (US)

( * ) Notice: Subject to any disclaimer, the term of this patent is extended or adjusted under 35 U.S.C. 154(b) by 326 days.

(21) Appl. No.: 15/947,970

(22) Filed: Apr. 9, 2018

(65) Prior Publication Data

US 2019/0307299 A1 Oct. 10, 2019

(51) Int. Cl.

| | |
|---|---|
| ***A47K 10/26*** | (2006.01) |
| ***A47K 10/36*** | (2006.01) |
| ***A47K 10/42*** | (2006.01) |

(52) U.S. Cl.

CPC ..... *A47K 10/26* (2013.01); *A47K 10/3625* (2013.01); *A47K 10/426* (2013.01); *A47K 2010/3668* (2013.01); *B65H 2511/33* (2013.01); *B65H 2701/1924* (2013.01)

(58) Field of Classification Search

CPC .. A47K 10/26; A47K 10/426; A47K 10/3625; A47K 2010/3668; B25H 2511/33; B25H 2701/1924

See application file for complete search history.

(56) References Cited

U.S. PATENT DOCUMENTS

| | | | | |
|---|---|---|---|---|
| 2,930,663 A | | 3/1960 | Weiss | |
| 3,017,131 A | | 1/1962 | Wooster | |
| 3,269,592 A | | 8/1966 | Slye et al. | |
| 3,288,387 A | | 11/1966 | Craven, Jr. | |
| 3,628,743 A | * | 12/1971 | Bastian | A47K 10/32 242/560.1 |
| 3,843,218 A | | 10/1974 | Krueger et al. | |
| 3,858,951 A | | 1/1975 | Rasmussen | |
| 3,917,191 A | * | 11/1975 | Graham, Jr. | A47K 10/3687 242/560.1 |

(Continued)

FOREIGN PATENT DOCUMENTS

| | | |
|---|---|---|
| CA | 2760805 A1 | 11/2010 |
| EP | 1097665 A2 | 5/2001 |

(Continued)

OTHER PUBLICATIONS

International Search Report and Written Opinion for related Application No. PCT/US2019/025621, dated Jul. 24, 2019.

*Primary Examiner* — William A. Rivera

(74) *Attorney, Agent, or Firm* — Womble Bond Dickinson (US) LLP

(57) ABSTRACT

A sheet material dispenser can include a sheet material transfer assembly operable to automatically transfer feeding or dispensing of sheet material between a plurality of supplies of sheet material. The sheet material transfer assembly can include a frame that is movable between a plurality of positions including a first position that facilitates feeding of the sheet material from a first supply of sheet material, and a second position that facilitates feeding or dispensing of sheet material from a second supply of sheet material. The frame of the sheet material transfer system can shift or move to the second position for dispensing sheet material from the second supply of sheet material when the first supply of sheet material is fully dispensed.

20 Claims, 16 Drawing Sheets

(56) References Cited

U.S. PATENT DOCUMENTS 4,010,909 A * 3/1977 Bastian ..... A47K 10/3687 242/560.1
4,067,509 A 1/1978 Graham, Jr. et al.
4,165,138 A * 8/1979 Hedge ..... A47K 10/3656 242/560
4,317,547 A * 3/1982 Graham, Jr. ..... A47K 10/3687 242/560.1
4,358,169 A 11/1982 Filipowicz et al.
4,378,912 A 4/1983 Perrin et al.
4,403,748 A * 9/1983 Cornell ..... A47K 10/3687 226/129
4,712,461 A 12/1987 Rasmussen
5,131,302 A 7/1992 Watanabe
5,375,785 A 12/1994 Boone et al.
5,400,982 A * 3/1995 Collins ..... A47K 10/3687 242/560
5,526,973 A 6/1996 Boone et al.
5,558,302 A 9/1996 Jesperson
5,604,992 A 2/1997 Robinson
5,620,128 A 4/1997 Dingman et al.
5,857,393 A 1/1999 Kohiyama
5,924,617 A 7/1999 LaCount et al.
5,979,821 A 11/1999 LaCount et al.
6,145,779 A 11/2000 Johnson et al.
6,152,397 A * 11/2000 Purcell ..... A47K 10/3687 242/560.1
6,321,963 B1 11/2001 Gracyalny et al.
6,354,533 B1 3/2002 Jespersen
6,412,678 B2 7/2002 Gracyalny et al.
6,460,798 B1 * 10/2002 Haen ..... A47K 10/3687 242/560
6,592,067 B2 7/2003 Denen et al.
6,648,267 B2 11/2003 Stanland et al.
6,685,074 B2 2/2004 Gracyalny et al.
6,736,348 B1 5/2004 Formon et al.
6,793,170 B2 9/2004 Denen et al.
6,826,985 B2 * 12/2004 Broehl ..... B65H 35/08 225/1
6,826,991 B1 12/2004 Rasmussen et al.
6,830,210 B2 12/2004 Formon et al.
6,838,887 B2 1/2005 Denen et al.
6,871,815 B2 3/2005 Moody et al.
7,017,856 B2 3/2006 Moody et al.
7,083,138 B2 8/2006 Elliott et al.
7,114,677 B2 10/2006 Formon et al.
7,168,602 B2 1/2007 Broehl
7,182,288 B2 2/2007 Denen et al.
7,182,289 B2 2/2007 Moody et al.
7,213,782 B2 5/2007 Osborne et al.
7,237,744 B2 7/2007 Morris et al.
7,270,292 B2 9/2007 Rasmussen
7,296,765 B2 11/2007 Rodrian
7,341,170 B2 3/2008 Boone
7,370,824 B1 5/2008 Osborne
7,380,748 B2 6/2008 Goeking et al.
7,422,174 B2 9/2008 Elliott et al.
7,624,664 B2 12/2009 Morris et al.
7,698,980 B2 4/2010 Morris et al.
7,793,882 B2 9/2010 Reinsel et al.
7,832,678 B2 11/2010 Hjort et al.
7,841,558 B2 11/2010 Elliott et al.
7,845,593 B2 12/2010 Formon et al.
7,946,522 B2 5/2011 Lewis et al.
7,963,475 B2 6/2011 Rodrian
7,967,235 B2 6/2011 Forman et al.
7,980,506 B2 7/2011 Kling et al.
7,987,756 B2 8/2011 Lewis et al.
8,083,170 B2 12/2011 Troutman et al.
8,162,252 B2 4/2012 Cittadino et al.
8,418,950 B2 4/2013 Hagleitner
8,439,293 B2 5/2013 Hagleitner
8,448,890 B2 * 5/2013 Hagleitner ..... A47K 10/3612 242/560.1
8,496,198 B2 7/2013 Cittadino et al.
8,616,489 B2 12/2013 Goeking et al.
8,777,149 B2 7/2014 Goeking et al.
8,800,415 B2 8/2014 Osborne
8,882,021 B2 11/2014 Cittadino et al.
8,910,898 B2 * 12/2014 Hagleitner ..... A47K 10/3687 242/560.1
8,919,688 B2 12/2014 Kuehneman et al.
9,326,648 B2 5/2016 Trampolski
9,370,283 B2 6/2016 Fellhoelter
9,604,811 B2 3/2017 Case et al.
9,645,561 B2 5/2017 Borke et al.
9,661,958 B2 5/2017 Moody et al.
9,681,783 B2 6/2017 Goeking et al.
9,701,508 B2 7/2017 Diamond
9,756,992 B2 9/2017 Osborne
9,839,333 B2 12/2017 Goeking et al.
9,907,441 B2 3/2018 Osborne et al.
9,918,598 B2 3/2018 Osborne
9,999,326 B2 6/2018 Borke et al.
10,105,020 B2 10/2018 Carper et al.
2002/0073821 A1 * 6/2002 Broehl ..... A47K 10/3612 83/436.15
2002/0109036 A1 8/2002 Denen et al.
2003/0168489 A1 9/2003 Formon et al.
2003/0168550 A1 9/2003 Formon et al.
2003/0169046 A1 9/2003 Morris
2004/0004152 A1 1/2004 Kapiloff et al.
2004/0004153 A1 1/2004 Kapiloff et al.
2004/0134924 A1 * 7/2004 Hansen ..... A47K 10/36 221/9
2004/0160234 A1 8/2004 Denen et al.
2004/0178297 A1 9/2004 Moody et al.
2005/0056721 A1 3/2005 Rasmussen et al.
2005/0072874 A1 4/2005 Denen et al.
2005/0127232 A1 6/2005 Moody et al.
2005/0167541 A1 8/2005 Osborne
2006/0034649 A1 2/2006 Han et al.
2008/0011772 A1 1/2008 Morris et al.
2008/0087758 A1 4/2008 Formon et al.
2008/0099595 A1 5/2008 Lewis et al.
2008/0245922 A1 10/2008 Fellhoelter
2009/0314874 A1 12/2009 Kling et al.
2010/0286817 A1 11/2010 Goeking et al.
2010/0286818 A1 11/2010 Goeking et al.
2011/0253829 A1 10/2011 Goeking et al.
2012/0312853 A1 12/2012 Osborne et al.
2013/0248644 A1 9/2013 Goeking et al.
2013/0320130 A1 12/2013 Osborne
2014/0110522 A1 4/2014 Goeking et al.
2014/0263811 A1 9/2014 Goeking et al.
2014/0263812 A1 9/2014 Osborne
2014/0367507 A1 12/2014 Trampolski
2015/0157177 A1 6/2015 Carper et al.
2015/0297043 A1 10/2015 Osborne et al.
2015/0327735 A1 11/2015 Himmelmann
2015/0342423 A1 12/2015 Kling
2016/0347567 A1 12/2016 Tagashira
2016/0353945 A1 12/2016 Osborne
2016/0353946 A1 12/2016 Osborne
2016/0353947 A1 12/2016 Osborne
2017/0055787 A1 3/2017 Borke
2017/0057775 A1 3/2017 Kobs et al.
2017/0074388 A1 3/2017 Cittadino et al.
2017/0112335 A1 4/2017 Diamond
2017/0112336 A1 4/2017 Ruthven et al.
2017/0188759 A1 7/2017 Borke et al.
2017/0188760 A1 7/2017 Henson et al.
2017/0190535 A1 7/2017 Case et al.
2017/0209006 A1 7/2017 Rozek et al.
2017/0251884 A1 9/2017 Carignan et al.
2017/0258278 A1 9/2017 Moody et al.
2017/0290471 A1 10/2017 Borke et al.
2017/0290472 A1 10/2017 Borke et al.
2017/0290473 A1 10/2017 Borke et al.
2017/0367547 A1 12/2017 Osborne
2018/0110380 A1 4/2018 Phelps
2018/0146829 A1 5/2018 Osborne

(56) References Cited

U.S. PATENT DOCUMENTS

| | | | |
|---|---|---|---|
| 2018/0153360 | A1 | 6/2018 | Osborne, Jr. et al. |
| 2018/0263435 | A1 | 9/2018 | Osborne, Jr. |

FOREIGN PATENT DOCUMENTS

| | | | |
|---|---|---|---|
| EP | 1097665 | A3 | 1/2003 |
| EP | 1321084 | A1 | 6/2003 |
| EP | 1232715 | B1 | 11/2005 |
| EP | 1716800 | A2 | 11/2006 |
| EP | 2377442 | A1 | 10/2011 |
| EP | 2846466 | A3 | 6/2015 |
| EP | 2040594 | B1 | 4/2018 |
| EP | 3007599 | B1 | 6/2018 |
| JP | 2010233971 | A | 10/2010 |
| WO | WO2002000083 | A1 | 1/2002 |
| WO | WO2008004919 | A1 | 1/2008 |
| WO | WO2010129741 | A2 | 11/2010 |
| WO | WO2014200624 | A1 | 12/2014 |
| WO | WO2016/100462 | A1 | 6/2016 |

* cited by examiner

SHEET MATERIAL TRANSFER SYSTEM/ASSEMBLY FOR A DISPENSER

TECHNICAL FIELD

The present disclosure is directed to, in one aspect, dispensers for flexible sheet materials, and in particular, to a dispenser with a sheet material transfer mechanism for selectively transferring feeding/dispensing of sheet material between a plurality of supplies of sheet material.

BACKGROUND

Dispensers for sheet materials, such as for dispensing towels, tissue or other paper products, are commonly used in hospitals, restrooms, and other facilities. Some dispensers have more than one supply of sheet material, e.g., multiple rolls of sheet material, for dispensing/feeding from the dispensers, and when a supply of sheet material in such dispensers is running low or has been fully dispensed, transfer of the feeding of sheet material to a new supply generally must be manually performed. In addition, with some dispensers, when a supply of sheet material is running low, feeding/dispensing may be modified such that sheet material from multiple supplies may be dispensed/fed at the same time, i.e., double sheets may be dispensed simultaneously, to ensure the supply of sheet material that is running low is fully dispensed. Such practices, however, can waste a significant portion of sheet material. Further, since transfer of feeding of sheet material generally must be manually performed, when the supply of sheet material being fed is fully exhausted, the dispenser will not be able to dispense sheet material until the dispensing thereof is manually exchanged. Accordingly, it can be seen that a need exists for a dispenser having a sheet material transfer mechanism that can switch/transfer the feeding/dispensing of sheet material between a plurality of supplies of sheet material when at least one supply of sheet material is running low or has been fully dispensed. The present disclosure addresses these problems and other related and unrelated problems in the art.

SUMMARY

Briefly described, the present disclosure is directed to a dispenser assembly for dispensing sheet materials, such as towels, tissues, and/or other paper products. The dispenser assembly generally includes a housing with a plurality of supplies of sheet material, e.g., two or more supply rolls of sheet material, rotatably supported/mounted therein. The housing further may include a feed roller rotatably mounted therealong to facilitate dispensing/feeding the sheet material from the supply rolls along a feed or discharge path toward and through a discharge throat or chute arranged along the housing. The feed roller can be driven, for example, by a drive system including a motor. Alternatively, or in addition, however, the feed roller can be manually operated, for example, in response to an operator or user engaging a lever, knob, or otherwise manually engageable actuator. The housing also may include at least one pressing or guide roller arranged along the feed path and adjacent the feed roller to guide the sheet material therebetween and toward the discharge throat/chute.

Additionally, with embodiments of the present disclosure, the dispenser assembly can include a sheet material transfer system/assembly for selectively transferring feeding/dispensing of sheet material between the plurality of supply rolls of sheet material. The sheet material transfer system/assembly can be movable between a plurality of positions or configurations, for example, a first position or configuration that facilitates feeding of the sheet material from at least one (e.g., a first or stub) supply roll of sheet material, and a second position or configuration that facilitates feeding/dispensing of sheet material from at least one additional (e.g., a second or a main/full) supply roll of sheet material. The sheet material transfer system/assembly also can shift or otherwise move to the second position/configuration to dispense/feed sheet material from the second supply roll of sheet material when the first supply of sheet material (e.g., the stub roll) is running low or has been substantially exhausted/fully dispensed from the dispenser assembly.

According to embodiments of the present disclosure, the sheet material transfer system/assembly can include a movable support assembly or a frame that at least partially supports a plurality of guide roller assemblies. The guide roller assemblies can at least partially engage the sheet material supplied/dispensed from the plurality of supply rolls and further can facilitate the transfer of feeding/dispensing of sheet material between the supply rolls. In one example, the plurality of guide roller assemblies can include a first guide roller assembly that at least partially engages a portion of sheet material being fed from the first supply roll, and a second guide roller assembly that at least partially engages a portion of the sheet material fed from the second supply roll. The support frame for the guide roller assemblies generally will be rotatably or pivotably mounted along the housing such that the frame can rotate or otherwise move the guide roller assemblies to facilitate transfer of the feeding/dispensing of the sheet material between the first and second supply rolls of sheet material. The frame also can be rotatably biased or urged by one or more biasing members, for example, toward the second position to facilitate feeding of the sheet material from the second supply.

The frame also can comprise a series of supports, arms or other parts including opposing side supports rotatably or pivotably coupled to the side(s), or other portions, of the housing. At least one of the side supports can be in communication with the biasing member urging the frame toward the second position. Each side support further can be coupled to the first guide roller assembly at a first end, and to the second guide roller assembly at a second end thereof, such that the first and second guide roller assemblies extend at least partially between, and are rotatable with respect to the side supports. The frame also can have additional support members or arms that extend between and connect the opposing side supports. For example, at least one support member can extend between the side supports and can be connected thereto at a position at or substantially adjacent the second end of each of the side supports, and also can be positioned substantially proximate the second guide roller assembly.

In addition, with embodiments of the present disclosure, the first guide roller assembly can include at least one guide roller that at least partially engages sheet material being fed or dispensed from the first supply roll of sheet material, while the second guide roller assembly can include at least one guide roller that engages at least a portion of sheet material being fed or dispensed from the second supply roll of sheet material. The at least one guide roller of the first guide roller assembly generally will include a cylindrical body rotatably coupled to the side supports of the frame, with a series of spaced projections or disks that can at least partially define a series of notches or grooves therebetween. The spaced projections of the guide roller also can be configured to be at least partially received within a series of corresponding grooves or notches defined along an associated member, e.g., a support, arm, or other suitable member, positioned adjacent the first guide roller assembly. The projections spaced along the body of the guide roller further can have a circumferential/annular surface that will at least partially engage the sheet material fed or dispensed from the first supply roll. The member also can have a series of spaced projection portions, each with a surface or face that at least partially engages a portion of the sheet material as it is fed from the first supply roll.

In an additional example, the first guide roller assembly can include a plurality of guide rollers, with each guide roller connected to the side supports of the frame, e.g., at or adjacent the first ends thereof, such that the guide rollers are arranged generally coaxial and generally spaced apart from each other. Each guide roller of the pair of guide rollers further can have one or more projections that are sized or otherwise configured to be received within one or more corresponding notches or grooves defined in the associated member (or member) that extends adjacent the pair of rollers.

The member(s) adjacent to guide roller(s) further can be biased, e.g., by one or more springs, to engage the sheet material against the guide roller and to urge the frame toward its first position. The member(s) adjacent the guide roller(s) also can be moveable, e.g., pivotable, rotatable, etc., between a plurality of positions to facilitate loading/unloading of the first supply of sheet material.

Additionally, with embodiments of the present application, sheet material from the first supply roll may be fed between the at least one roller (or the pair of spaced apart, coaxial rollers) of the first guide roller assembly and the adjacent support of the transfer mechanism frame such that the annular surfaces of the spaces projections of the at least one roller guide roller (or pair of spaced apart, coaxial rollers) and the surfaces or faces of projecting portions of the adjacent support at least partially contact or otherwise engage the sheet material being fed from the first supply roll therebetween. The sheet material from the first supply roll further will be fed or directed into frictional engagement with the feed roller, which will pull or drive the sheet material from the first supply roll along a dispensing path toward and through the discharge throat/chute of the dispenser.

When the sheet material from the first supply roll is substantially fully dispensed or exhausted, the projections of the roller (or pair of rollers) of the first guide roller assembly generally will move into corresponding grooves of the adjacent support. This enables the frame to be rotated toward its second position to facilitate transfer of active feeding or dispensing to the second supply roll of sheet material.

Furthermore, while the frame is in its first position and sheet material is being fed or dispensed from the first supply roll of sheet material, the guide roller of the second guide roller assembly will be arranged or located so as to be spaced apart from the feed roller; and generally will have at least a portion of the sheet material from the second supply roll engaged between the guide roller of the second guide roller assembly and one or more projecting portions of the additional frame support that extends between the side supports of the frame; which projecting portions can have an edge portion that at least partially grips and/or penetrates the sheet material so as to hold the sheet material along the at least one guide roller of the second guide roller assembly. For example, a portion or section of the sheet material from the second supply roll can be at least partially wrapped around or otherwise disposed about the guide roller of the second guide roller assembly and held in place by the edge portion of the projecting portions.

Accordingly, when the sheet material of the first supply roll is substantially fully dispensed or exhausted, causing or enabling the frame to be moved, rotated, or pivoted by the biasing member(s) toward its second position by an amount or distance sufficient to move the second guide roller assembly, with the portion of sheet material from the second supply of sheet material disposed thereabout, into engagement with the feed roller, the portion of sheet material disposed about the guide roller of the second guide roller assembly can be engaged against the feed roller so as to facilitate transition of the active feeding or dispensing of sheet material between the first and second supplies of sheet material. For example, the feed roller may at least partially contact or engage the portion of the sheet material disposed about the guide roller of the second roller assembly and separate the sheet material from the projecting portions thereof, e.g., the portions with the edge portion, for feeding the sheet material from the second roll supply along the discharge path toward and out of the discharge chute/throat of the dispenser assembly.

In another aspect, embodiments of the present application can be directed to a method/process for operation of a dispenser assembly. In one example, the method can include feeding/dispensing sheet material from at least one supply of sheet material of a plurality of supplies of sheet material. When the sheet material from the first supply of sheet material is substantially exhausted or dispensed, moving a sheet material transfer assembly to a second position or configuration for feeding sheet material from at least one additional supply of sheet material. For example, when the sheet material from the first supply is fully dispensed, the frame of a transfer assembly can be rotatably biased and thus caused to pivot, rotate, or otherwise move to a second position, wherein at least one additional roller assembly, with sheet material from the at least one additional supply of sheet material received thereabout, is moved into driving engagement with the feed roller of the dispenser, such that the sheet material from the additional supply is engaged between the at least one additional roller assembly and the feed roller to facilitate feeding of the sheet material from the additional supply of sheet material.

Accordingly, with embodiments of the present disclosure, the transfer assembly can allow for substantially seamless transfer of feeding of sheet material between the first supply (e.g., the stub roll) and the second supply (e.g., a main or full roll) of sheet materials without requiring refeeding or manual manipulation of the first or second supply, while also preventing double sheet dispensing.

Those skilled in the art will appreciate the above stated advantages and other advantages and benefits of various additional embodiments by reading the following detailed description of the embodiments with reference to the below listed drawing figures.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the present disclosure and not in limitation thereof.

Figure 1A:
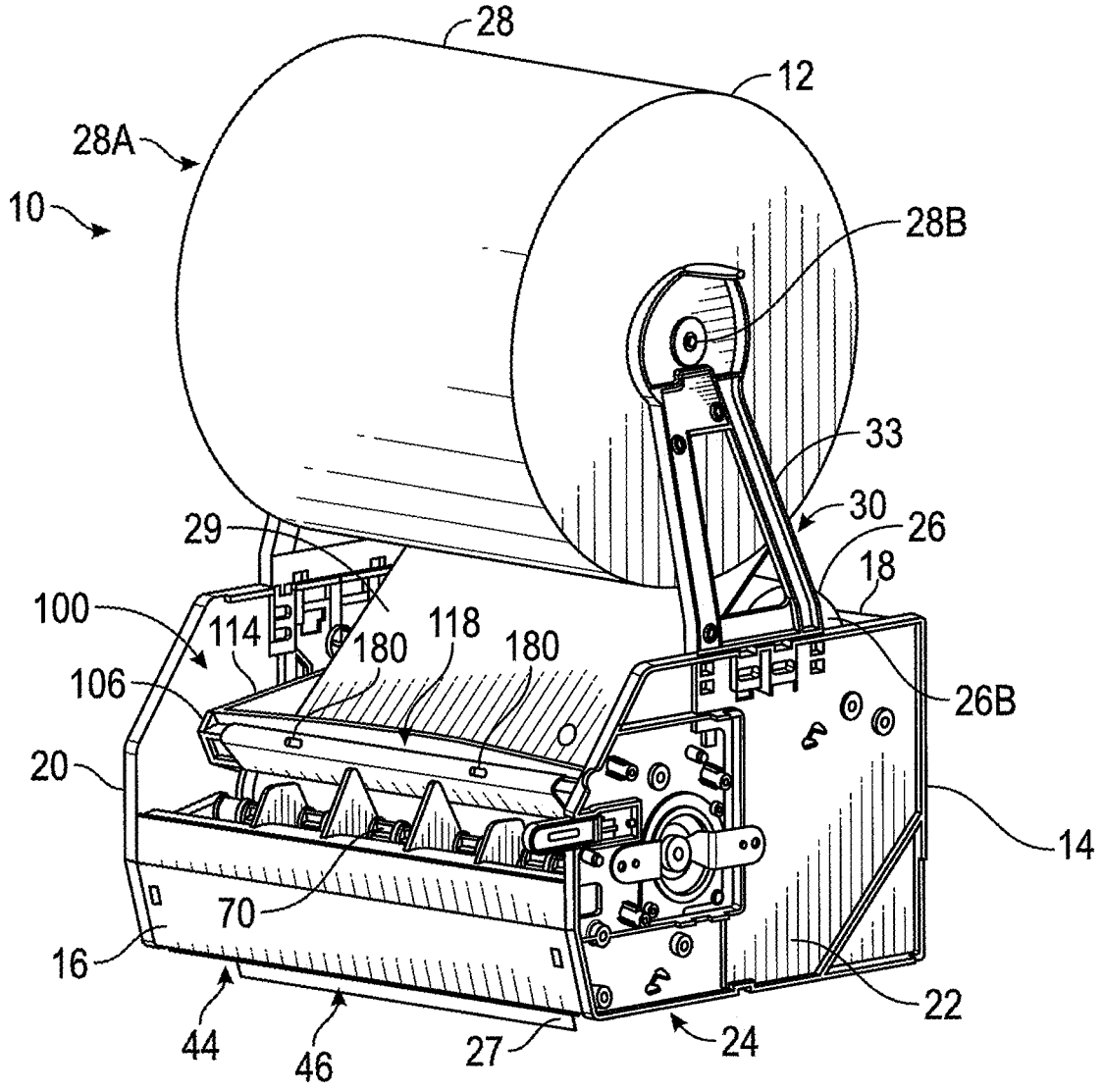
FIGS. 1A and 1B show perspective and partial cutaway views, respectively, of a dispenser assembly according to one aspect of the present disclosure.
Figure 1B:
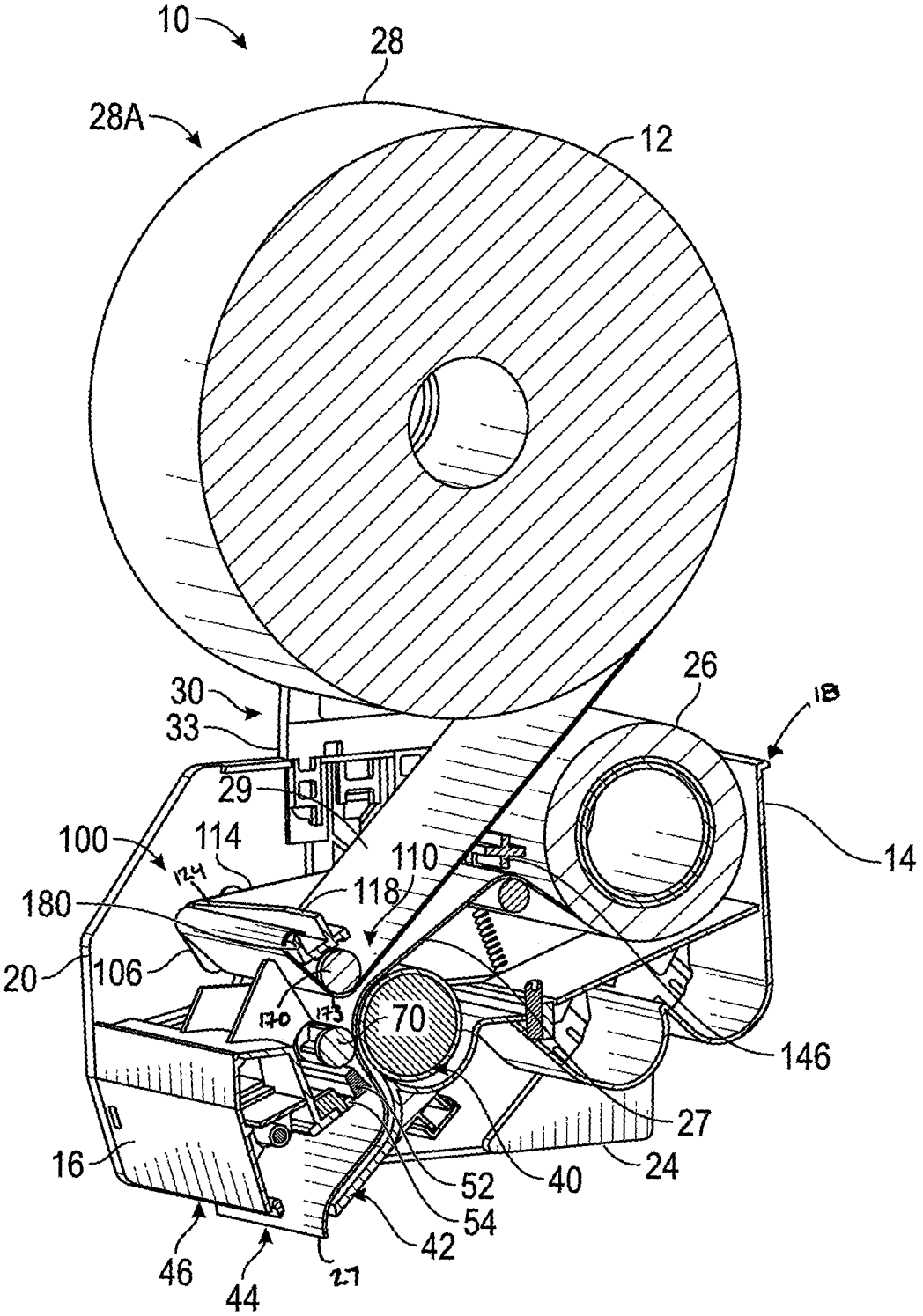

FIGS. 1A-12B show a dispenser assembly 10 for a sheet material, such as tissue, paper products and/or other suitable materials, having a sheet material transfer system/assembly 100 configured to facilitate the transfer feeding of sheet material between a plurality of supplies of sheet material received within/along the dispenser assembly. As shown in FIGS. 1A and 1B, the dispenser assembly 10 can include a dispenser housing 14 having front 16, rear 18, side 20/22, and bottom 24 sides or portions. The dispenser assembly 10 further includes a plurality of supplies of sheet material, for example, two or more supply rolls of sheet material 26/28 at least partially supported along the dispenser housing 14. The plurality of supplies of sheet material can include a first supply roll 26 and a second supply roll 28. The first and second supply rolls 26/28 can include new/undispensed rolls of sheet material and/or at least partially dispensed rolls of sheet material, e.g., stub rolls, etc. For example, the first supply roll 26 can be a "stub roll" that may be less than a full roll (e.g., a full roll that has been substantially dispensed) and that will be fully exhausted allowing the second supply roll 28 to automatically self-feed, with no delivery disruption experienced by users. It will be understood that, though two supply rolls 26/28 are shown in FIGS. 1A-2B, a greater number of supply rolls, such as 3 or more supply rolls, can be used without departing from the scope of the present disclosure. It will be further understood that the first supply roll 26 can include a new supply roll and the second supply roll 28 can include at least partially dispensed supply roll, e.g., a "stub roll," without departing from the scope of the present disclosure.

The supply rolls 28 and 26 generally will be rotatably coupled to the dispenser housing 14, for example, using one or more supports 30 and 32. As shown in FIGS. 1A and 1B, such supports 30/32 can include one or more arms 33/35 connected to the dispenser housing 14, such as at sides 20/22 (FIGS. 1A-B) or to a rear portion 18 (FIGS. 2A-B) thereof, and which can be rotatably coupled to the ends 28A/B and 26A/B of the supply rolls 28/26, so that the supply rolls 28/26 of sheet material can substantially freely rotate with respect to the arms 33 and 35 as the sheet material is pulled therefrom during a dispensing operation. The supply rolls 28/26 may be otherwise rotatably/movably mounted to, or along, the dispenser housing 14, however, without departing from the scope of the present disclosure. For example, the ends 26A/B and 28A/B of the supply rolls 26 and 28 may be at least partially received within grooves defined in a portion of the dispenser housing 14, for example, side portions 20/22, or, alternatively, can be directly connected to at least a portion of the dispenser housing 14, such as with one or more bearing(s) or other suitable connection mechanism for rotatably mounting the rolls/supplies of sheet material.

Additionally, as shown in FIGS. 1B, 3-6, 9A-B, 11A-B, and 12A-B the dispenser assembly 10 further generally will include a feed roller 40 rotatably mounted therein. The feed roller 40 will be operable to rotate/pull and guide/feed the sheet material 12 along a feed or discharge path 42 towards a discharge chute 44 of the dispenser for dispensing or distribution of a length of the sheet material to a user. The discharge chute 44 can comprise an opening or slot 46 arranged along the bottom portion 24 of the dispenser housing 14 as generally shown in FIGS. 1A-B and 2A-B. A portion of the sheet material 12 will be at least partially disposed about and in engagement or contact with the feed roller 40, such that, upon rotation of the feed roller 40 the sheet material 27 or 29 will be pulled, causing the supply rolls 26/28 to be rotated and an amount or length of sheet material 12 to thus be fed to and through the discharge chute 44. The feed roller 40 can have a diameter selected for feeding a prescribed or predetermined or known length or amount of sheet material. For example, the feed roll 40 can have a diameter or size selected to feed a 6", 8", 10", 12", 14", 16", etc. or other integer or non-integer numbers therebetween or other suitable predetermined lengths, of sheet material for each revolution or pre-set series of revolution of the feed roller.

Figure 2B:
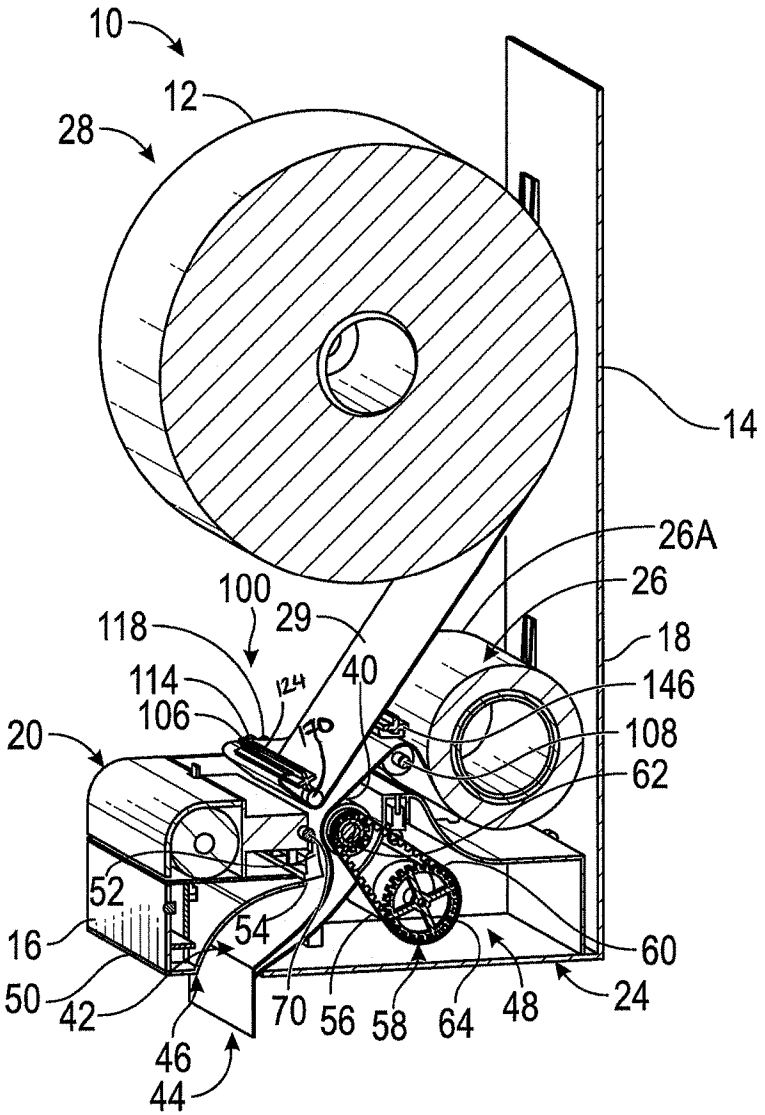
FIGS. 2A and 2B show perspective and partial cutaway views, respectively, of a dispenser assembly according to another aspect of the present disclosure.
Figure 5:
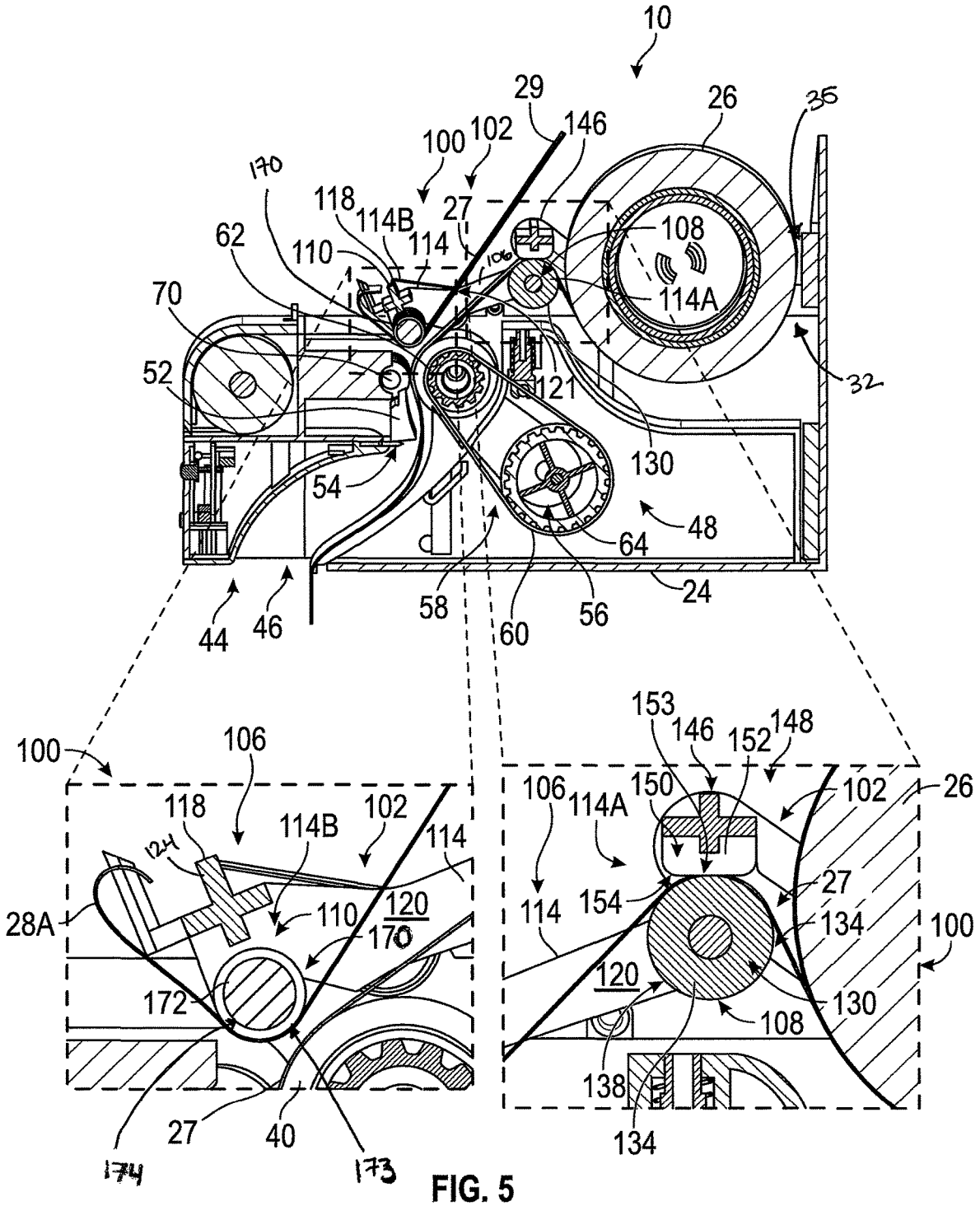
FIG. 5 shows cross-sectional views of the sheet material transfer system/assembly in the first position/configuration.

In one embodiment, the feed roller 40 can be manually driven, for example, an operator can actuate a knob or lever other suitable portion to drive movement/rotation of the feed roller 40 (not shown). Additionally, or in the alternative, the feed roller 40 can be automatically driven by a drive mechanism 48 (e.g., as shown in FIGS. 2B and 5) that activates when one or more sensors detect a predetermined condition, for example, when a sensor 50, such as an infrared sensor, detects the presence of a user's hand in front of, adjacent, or below the dispenser housing 14, or detects the presence or absence of sheet material extending from the discharge chute 44. The one or more sensors also can include a switch or lever or pawl member 52 arranged along a tear bar 54 (FIGS. 1B, 2B and 5) or other cutting mechanism that is activated when a user tears away a select amount of sheet material.

The drive mechanism 48 of the feed roller 40 generally can comprise a motor 56, such as a DC motor (e.g., a brush or brushless DC motor), an AC motor, stepper motor, servo motor or other similar motor or actuator. The motor 56 can be powered by a battery pack or other power source arranged at least partially within or along the dispenser housing 14. As shown in FIGS. 2B and 5, the motor 56 can be coupled to the feed roller 40 using a transmission assembly such as a belt transmission assembly 58 including a belt 60 that engages pulleys 62/64 connected to the feed roller 40 and motor 56. Alternatively, the drive mechanism 48 also can be integrated with the feed roller 40 and operatively coupled thereto, e.g., by one or more gears. The drive mechanism can include any suitable mechanisms/assemblies for transferring power between the motor and feed roller, such as a gear assembly with a series of gears, without departing from the scope of the present disclosure.

U.S. patent application Ser. Nos. 15/173,970, 15/185,776, and 15/185,937, which are incorporated by reference herein in their entireties, show example arrangements of integrated and other drive mechanisms for driving the feed roller 40. However, any suitable driving mechanism, arrangement, or configuration can be employed to drive the feed roller for feeding or dispensing sheet material, without departing from the scope of the present disclosure.

FIGS. 1B, 2B, and 5-6 further show that the dispenser assembly 10 can include one or more guide or pressing rollers 70 mounted along or substantially adjacent the feed roller 40. For example, the guide roller (or rollers) 70 can be located in a position so as to contact and/or functionally engage and guide the sheet material 12 therebetween as the sheet material is fed along the discharge path 42 for dispensing/feeding from the dispenser. The guide roller(s) 70 can be biased toward the feed roller 40, such as by one or more springs or other suitable biasing members to contact and engage the sheet material between each guide roller and the feed roller; however, one or more of the guide rollers can be fixed, i.e., unbiased, without departing from the scope of the present disclosure.

The dispenser 10 further can include one or more cutting mechanisms configured to cut, perforate, tear or otherwise enable the sheet material to be severed or separated from the supply of sheet material. In one example, a cutting mechanism can be disposed along or within the feed roller 40 and can be movable therewith to cut or perforate the sheet material 12 as it is dispensed. Additionally, or in the alternative, the cutting mechanism can include a tear bar 54, with a jagged or serrated edge, that is arranged along or adjacent the discharge chute 44 to allow a user to tear off a desired amount or length of sheet material 12 after it is dispensed. U.S. patent applications Ser. Nos. 15/185,776, 15/185,937, and 15/173,970, which are incorporated by reference herein in their entireties, provide example cutting mechanisms that can be used in the present disclosure; though any suitable cutting mechanism can be used without departing from the scope of the present disclosure.

Additionally, the dispenser 10 can include one or more monitoring systems (not shown) in communication with the first 26 and/or second 28 supply rolls, which monitoring systems can be operable to detect a remaining amount of sheet material for one or both of the supply rolls, for example, such as a monitoring system shown and described in U.S. patent application Ser. No. 15/922,157, which is incorporated by reference herein as if set for in its entirety.

As further shown in FIGS. 1A-12B, the dispenser 10 according to embodiments of the present application can include a sheet material transfer system/assembly 100 that is operable to facilitate transfer between dispensing/feeding of the plurality of supplies of sheet material, e.g., between supply rolls 26 and 28. The sheet transfer system/assembly 100 can facilitate a substantially seamless transfer of active feeding between the plurality of supply rolls, for example, if/when a supply roll, e.g., supply roll 26, of sheet material has been fully dispensed. The sheet material transfer system/assembly 100 can be movable/transferable between a plurality of positions or configurations 102/104, including a first position or configuration 102 that facilitates feeding/dispensing of sheet material 27 from the first supply roll 26 (FIGS. 3, 5, 7, and 9A), and a second position/configuration 104 that facilitates feeding or pulling of sheet material 29 from the second supply roll 28 (FIGS. 4, 6, 8, and 9B). As shown in FIGS. 3, 5, 7, and 9A, when the sheet material transfer system/assembly 100 is in its first position 102, sheet material 27 is actively fed/dispensed from the first supply roll 26. The sheet material transfer assembly 100 also will be configured to rotate, pivot, and/or otherwise move (FIGS. 10A-10B and 11A-11B) to its second position 104 for drawing and/or feeding sheet material 29 from the second supply roll 28, for example, when the first supply roll 26 has been exhausted/fully dispensed.

FIGS. 1A-12B additionally show that the sheet material transfer assembly 100 also can include a support assembly or frame 106 that at least partially supports a plurality of guide or pressing roller assemblies 108, 110. The guide roller assemblies 108/110 can at least partially engage sheet material 27/29 supplied from the plurality of supply rolls 26/28 and further can facilitate transfer of active feeding and/or dispensing of sheet material between the plurality of supply rolls. In one embodiment, as generally shown in FIGS. 3-11B, the plurality of guide roller assemblies 108, 110 can include a first guide roller assembly 108 that at least partially engages a portion of the sheet material 27 fed or dispensed from the first supply roll 26, and a second guide roller assembly 110 that at least partially engages a portion of sheet material 29 from the second supply roll 28.

The frame 106 generally is rotatably or pivotably mounted along the housing 14 so as to move the sheet material transfer assembly 100 between the first and second positions as needed to facilitate transfer of the feeding and/or dispensing of the sheet material between the first and second 26/28 supply rolls. In addition, the frame 106 can be pivotably or rotatably biased, by one or more biasing members 112, such as a torsion spring(s) or other suitable biasing member(s) or mechanism(s), in a desired or selected direction, e.g., the biasing member(s) 112 can bias or urge the frame 106 toward its second position 104, as indicated in FIGS. 7 and 10B.

The frame 106 further generally comprises a series of supports, arms, or other members 114, 116, 118. These frame supports can include a pair of opposing side supports/arms 114, 116 that are rotatably/pivotably coupled to the side portions 20/22 of the housing 14. The series of frame supports further can include one or more additional supports, for example, one or more cross-wise members 118, extending between the side supports 114 and 116. The side supports 114 and 116 each can have a body 120, 122 with a generally rectangular cross-section, however, the side supports 114 and 116 can have any suitable shape or configuration, such as a circular, square, triangular cross-section, etc., without departing from the scope of the present disclosure. The bodies 120/122 of the side supports can be angled and/or can have one or more sloped/angled portions 121/123 (FIGS. 7-8), though their bodies 120/122 also can be generally straight (FIGS. 3-4), or have any other suitable configuration without departing from the scope of the present disclosure.

The biasing member(s) 112, e.g., torsion spring(s), may contact, engage, or otherwise be in communication with the bodies 120/122 of the supports 114/116. Each side support 114, 116 further can be coupled to the first guide roller assembly 108 at a first end 114A/116A, and to the second guide roller assembly 110 at a second end 114B/116B of the side supports 114/116, such that the first and second guide roller assemblies 108/110 extend at least partially between, and are rotatable with respect to, the side supports 114, 116, as generally indicated in FIGS. 5-11B.

Figure 6:
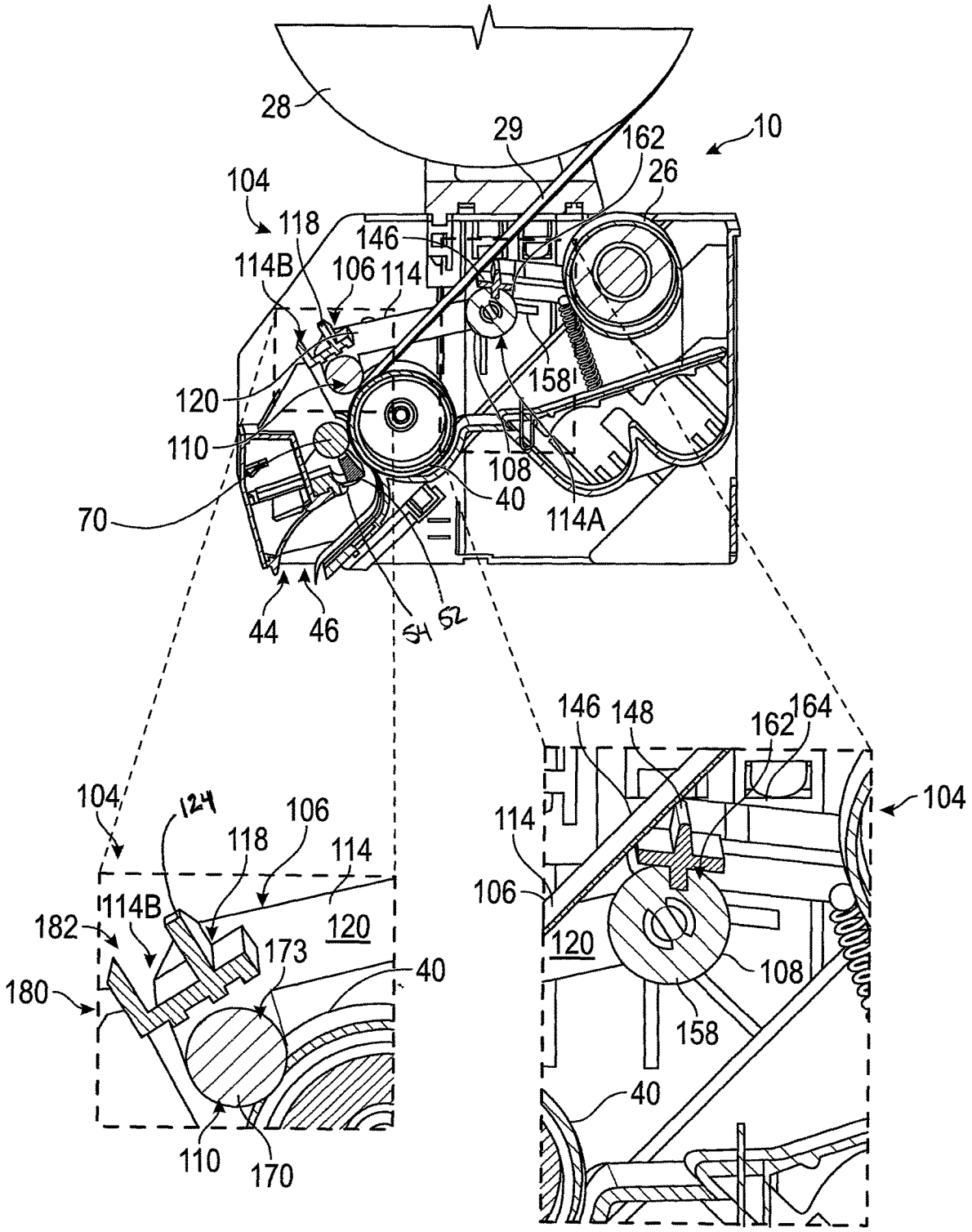
FIG. 6 shows cross-sectional views of the sheet material transfer system/assembly in the second position/configuration.
Figure 7:
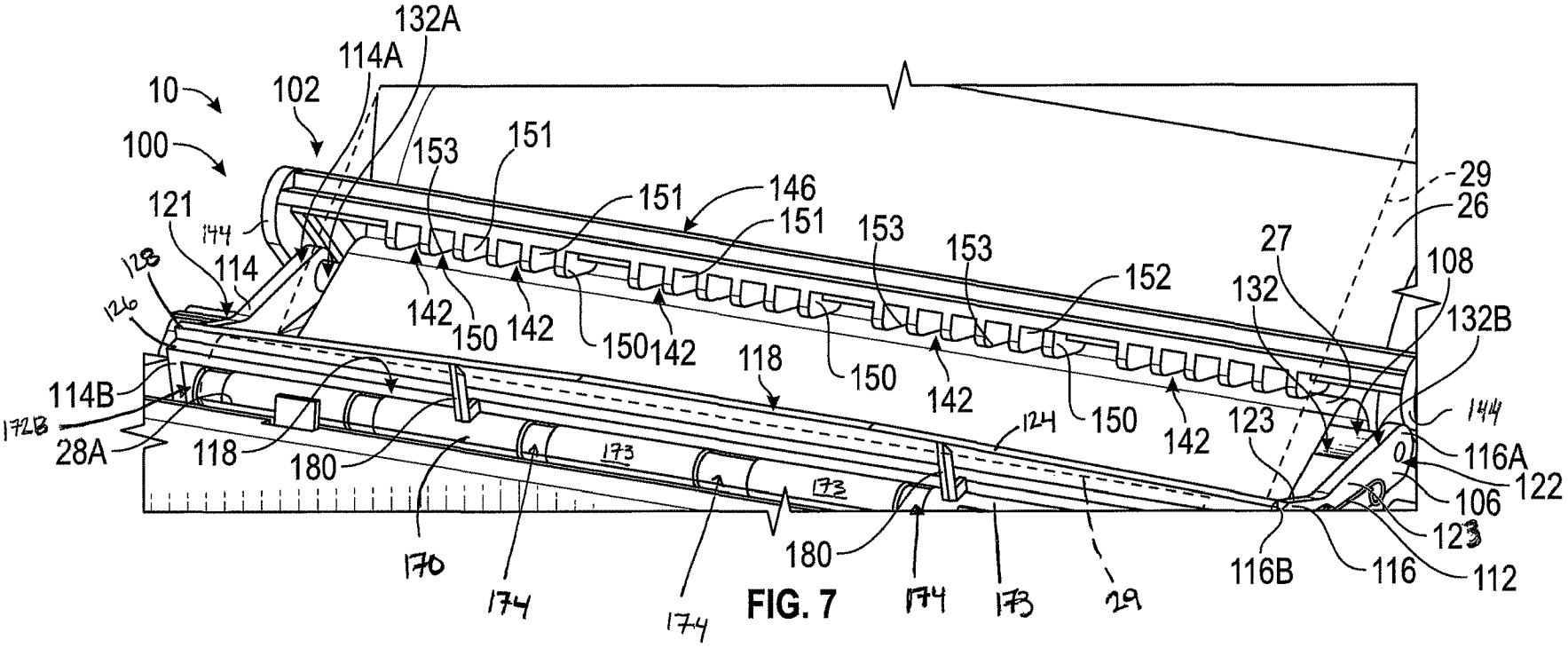
FIG. 7 shows a perspective view of a first guide roller assembly with the sheet material transfer system/assembly in the first position according to one aspect of the present disclosure.

FIGS. 3-11A further show that the additional support or cross-wise member 118 can extend between the side supports 114, 116 and can be connected thereto at a position along, substantially adjacent the second end 114B/116B of the side supports 114, 116, and can be positioned substantially proximate the second guide roller assembly 110. Cross-wise member 118 can have a body 124 with a plurality of sections, for example, two sections or portions 126/128 having substantially rectangular cross-sections that are arranged substantially perpendicular to each other (FIGS. 7 and 9A-B). The sections 126/128 can have a cross-section of varying size or dimensions (FIGS. 7 and 9A-B), though the cross-section can have a substantially continuous size or dimensions without departing from the scope of the present disclosure. It will be understood, however, that the body 124 of the cross-wise member 118 also can comprise any suitable size, shape, dimensions, and/or configuration, such as a rectangular, tubular, cylindrical shape or other suitable shape, without departing from the scope of the present disclosure.

Additionally, as shown in FIGS. 5, 7-8, 9A-B, 10A-10B, and 11A-11B, in one example embodiment, the first guide roller assembly 108 can include a guide roller 130 that at least partially engages portions of the sheet material 27 fed/dispensed from the first supply/roll 26 of sheet material. The roller 130 can include a body 132 generally made from a strong, lightweight material, such as a plastic or other synthetic material, though other materials, such as wood or other composites or metals, e.g., aluminum, with an insulating or static reducing material spaced thereabout, also can be used without departing from the scope of the present disclosure. The body 132 further generally will have a substantially cylindrical shape or a substantially circular cross-section, though any suitable shape or cross-section can be employed without departing from the scope of the present disclosure.

The guide roller body 132 further can have a series of spaced projections or sections 134 provided therealong and which at least partially define a series of notches or grooves 136. The projections or sections 134 can include a series of disk-like or substantially cylindrical portions spaced along the body 132, and can have an annular or circumferential surface 138 configured for at least partially contacting or otherwise engaging the sheet material 27. The ends 132A/132B roller body 132 also can be rotatably coupled to the first ends 114A/116A of the side supports 114/116.

Figure 8:
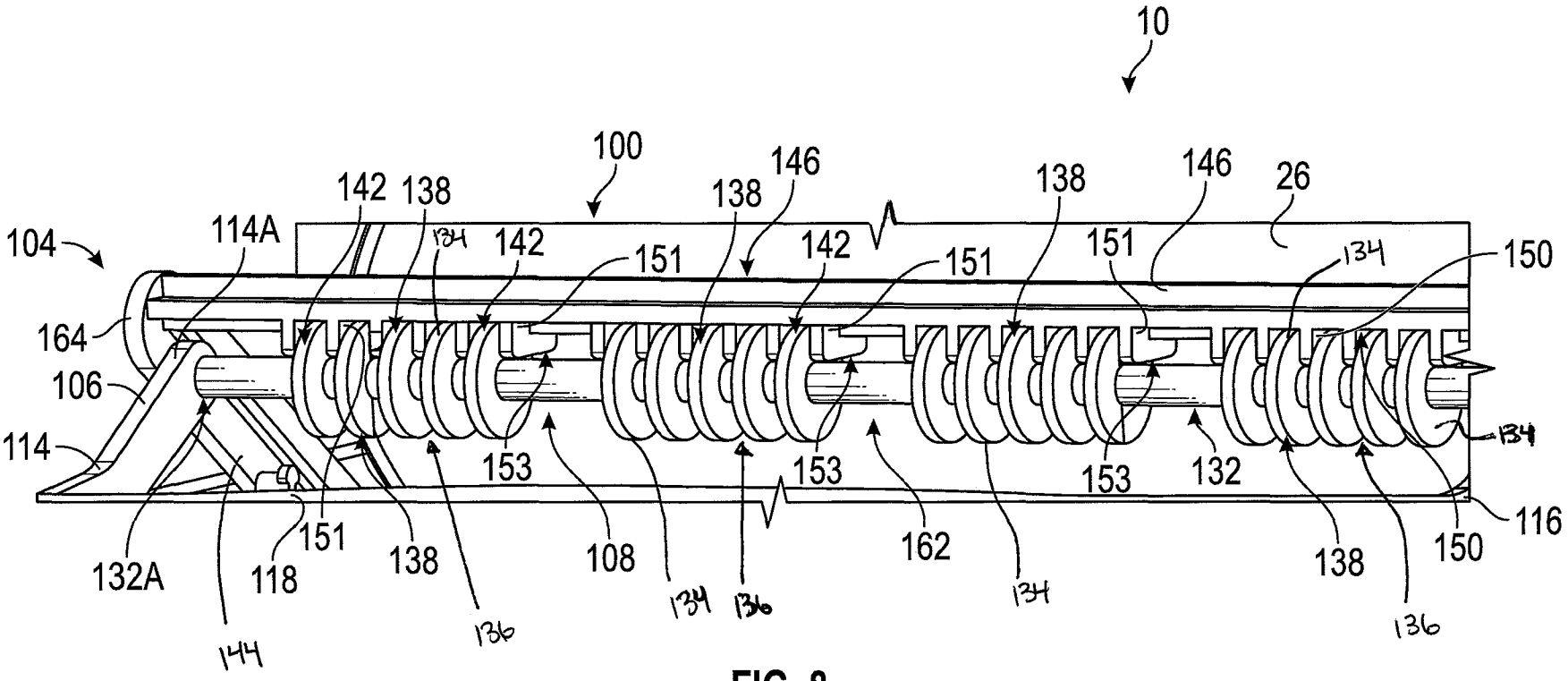
FIG. 8 shows a perspective view of the first guide roller assembly with the sheet material transfer system/assembly, with portions removed for clarity, according to one aspect of the present disclosure.
Figure 9B:
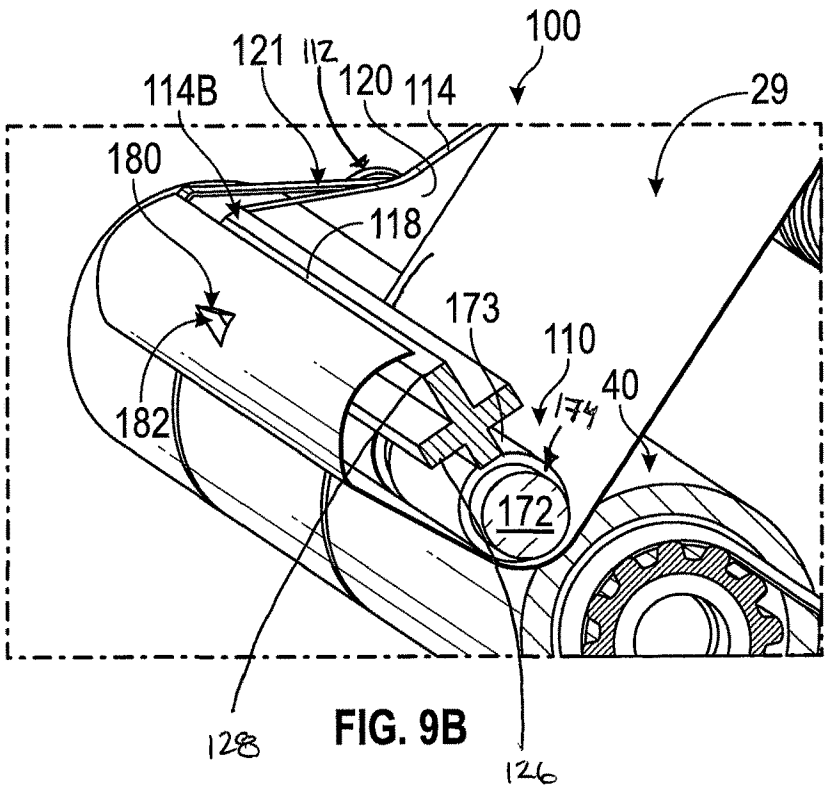
FIGS. 9A and 9B show a partial cutaway perspective view of a second guide roller assembly with the sheet material transfer system in the first and second positions.
Figure 9A:
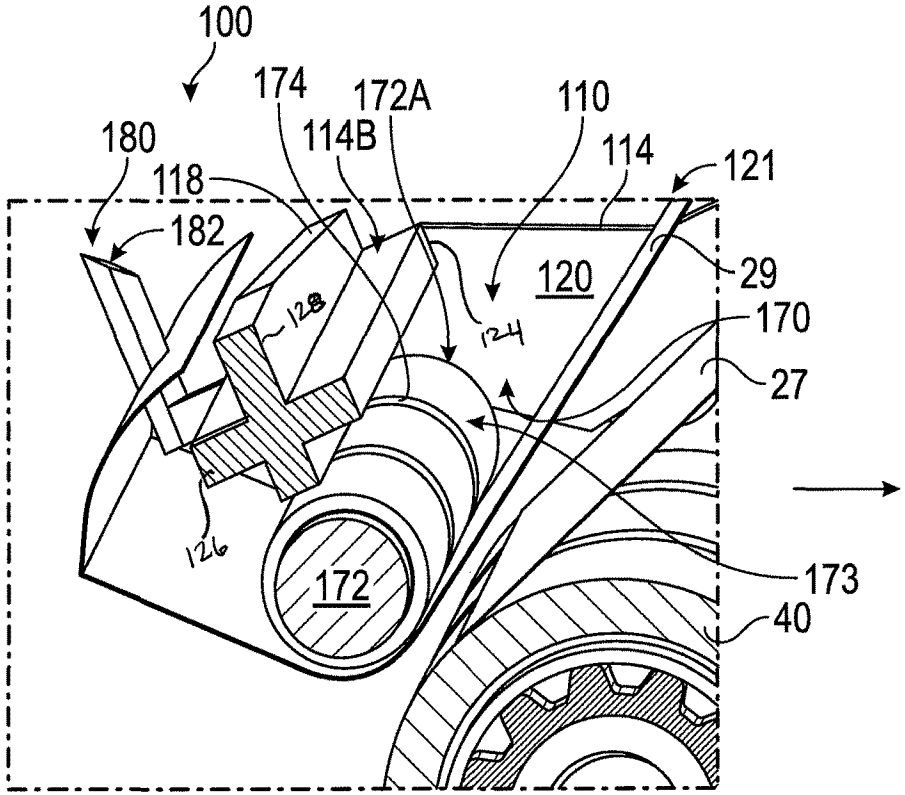

FIG. 8 shows that the spaced projections 134 generally are configured to be at least partially received within a series of corresponding grooves or notches 142 defined along a movable or pivotable member, e.g., a supporting arm, rod or other suitable member 146 positioned or arranged substantially adjacent or substantially proximate to the first guide roller assembly 108, and pivotally supported by side supports or arms 144 (FIGS. 7-8 and 12A-12B). The grooves 142 defined along the support arm 146 further may at least partially define a plurality of spaced portions or sections 150 therealong (FIGS. 7 and 8). The portions or sections 150 each can have a body 151 with a surface or face 153 configured to at least partially contact or engage the sheet material 27. The portions 134/150 of the roller 130 and support arm 146 can be configured to be received within each other's corresponding grooves 142/136 in an intermeshing or interlinking arrangement, for example, when the first supply 26 of sheet material has been fully dispensed.

The side supports 144 of the support arm 146 further can be coupled to one or more biasing members 149, e.g., tension springs or other suitable biasing members (e.g., torsion springs, etc.) to urge the surfaces/faces 153 into engagement with the sheet material 27, e.g., engaging the sheet material 27 between the portions 134/150 of the roller 130 and the support arm 146. The support arm 146 further can be rotatable or otherwise moveable between a series of positions 145, e.g., a raised/disengaged position, to facilitate loading of the first supply of sheet material 26, e.g., to load the stub roll for dispensing thereof (FIG. 12B), and a lowered engaged position 147 with the portions 150 being in position to engage the sheet material 27.

With the sheet material received between the guide roller 130 and the support arm 146, the biasing member 149 may cause the support arm 146 to engage the guide roller 130 through the sheet material 27 received therebetween so as to urge the frame 106 (to which the guide roller 130 is attached) towards its first position 102. Accordingly, the stiffness, spring constant, etc., of the biasing member(s) 149 can be selected to allow the support arm 146 to overcome the biasing of the frame 106 due to the biasing member(s) 112. The support arm 146 further has one or more mechanical stops 155 in communication therewith that stop movement of the support arm 146 (e.g., due to urging by the biasing member 149) such that when the first supply of sheet material has been fully dispensed and the portions 134/150 interlink/intermesh, the frame 106 is allowed to move towards the second position 104. For example, the mechanical stops 155 can include one or more surfaces or portions that engage (e.g., a portion 155A of the member or its arms can engage a portion 155B of the dispenser housing, such as a portion of side wall 20/22, etc.) to stop movement of the support arm and allow the frame 106 to rotate to its second position 104 when the first supply of sheet material 26 is exhausted.

Figure 3:
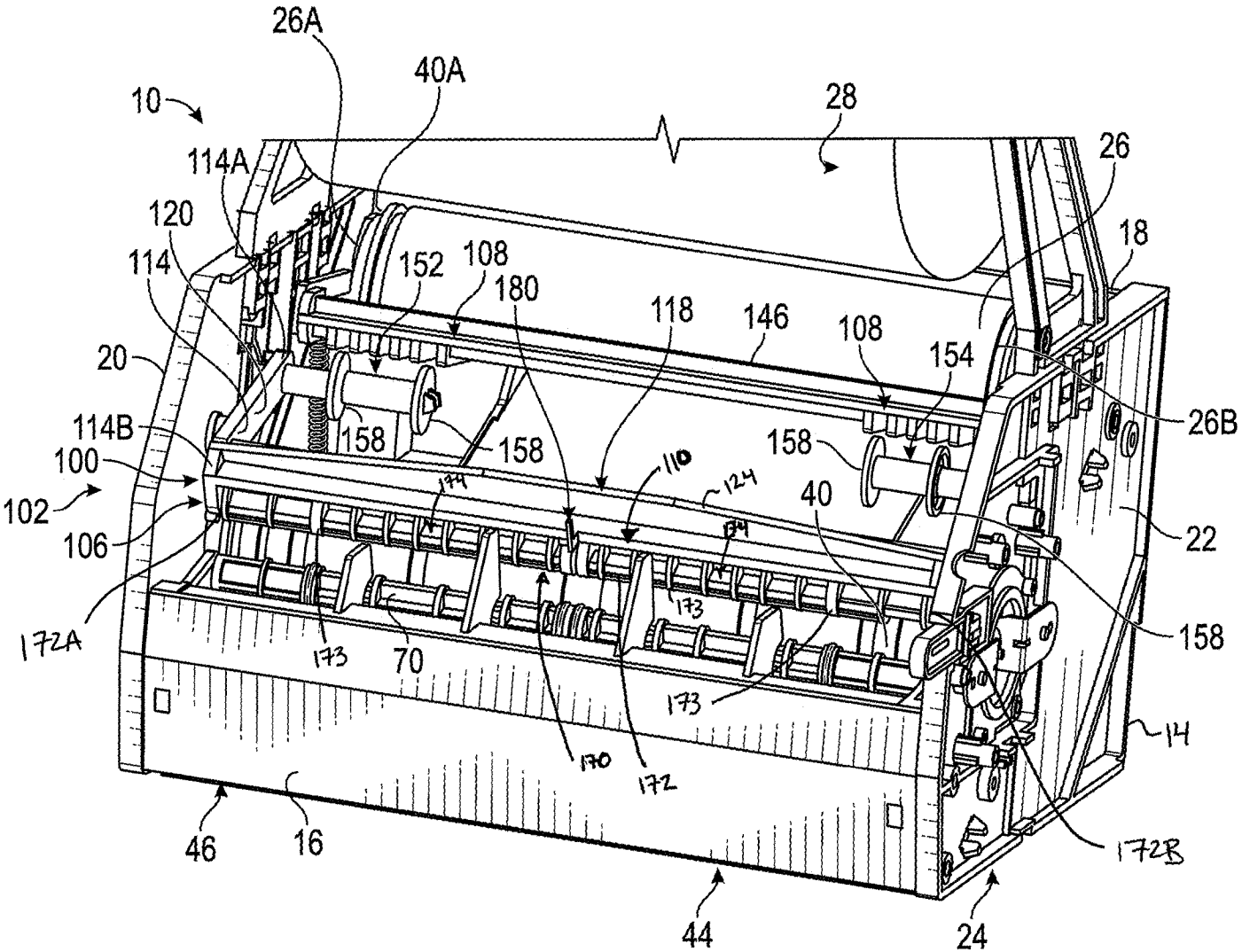
FIG. 3 shows a perspective view of a sheet material transfer system/assembly in a first position/configuration according to one aspect of the present disclosure.
Figure 4:
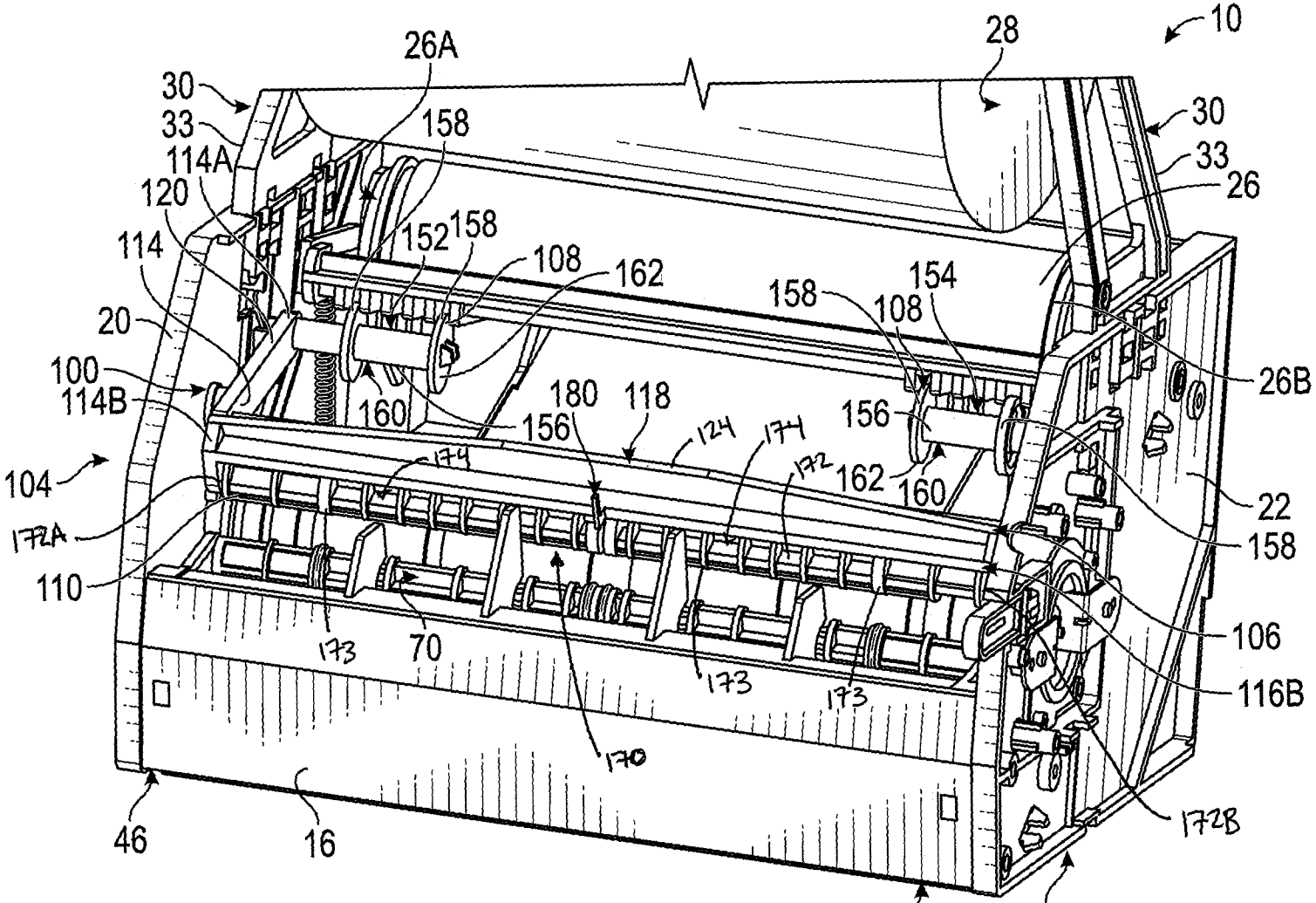
FIG. 4 shows a perspective view of the sheet material transfer system/assembly in a second position/configuration.
Figure 12A:
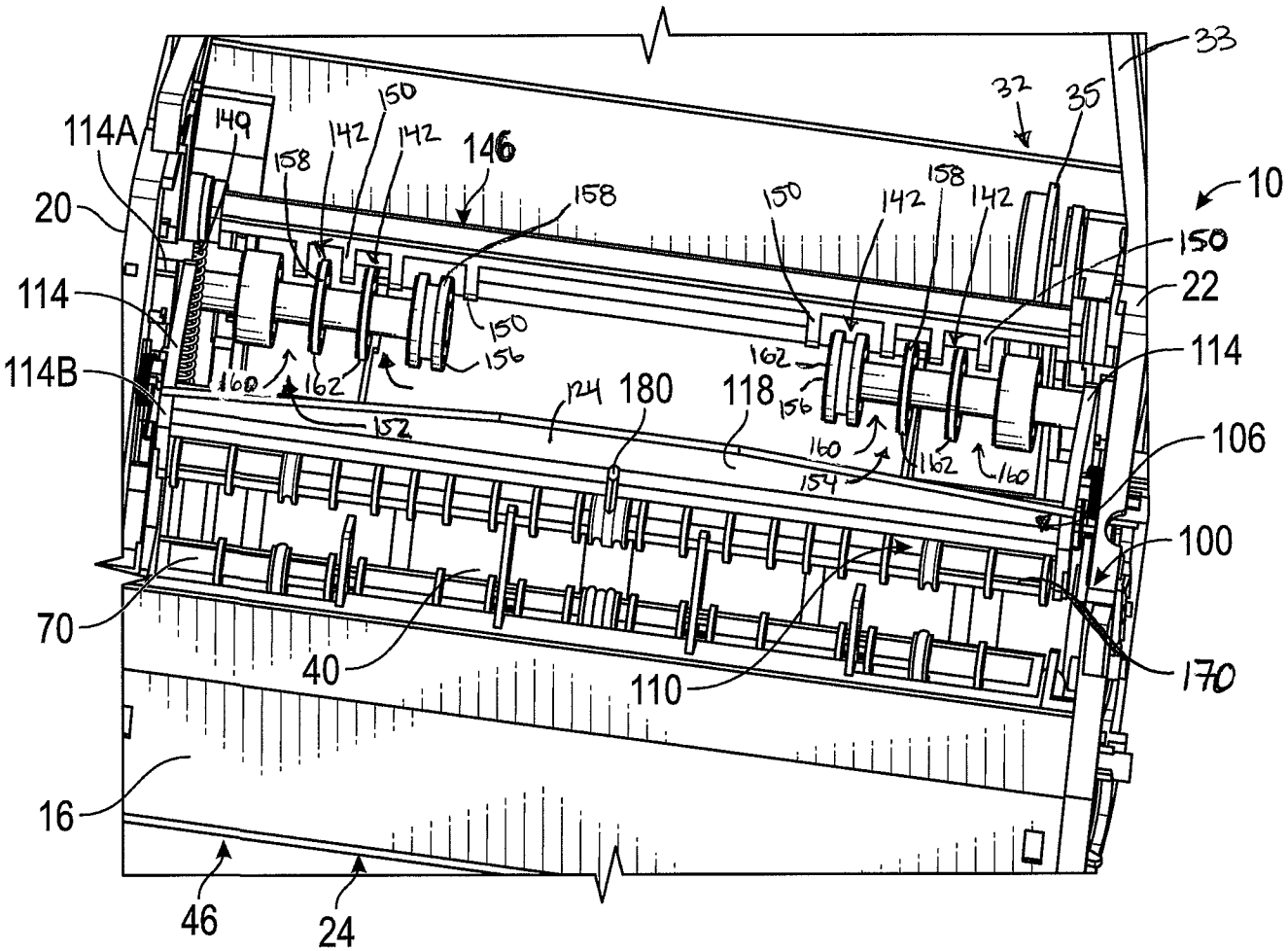
FIGS. 12A-12B show a sheet material transfer system/assembly according to yet another aspect of the present disclosure.
Figure 12B:
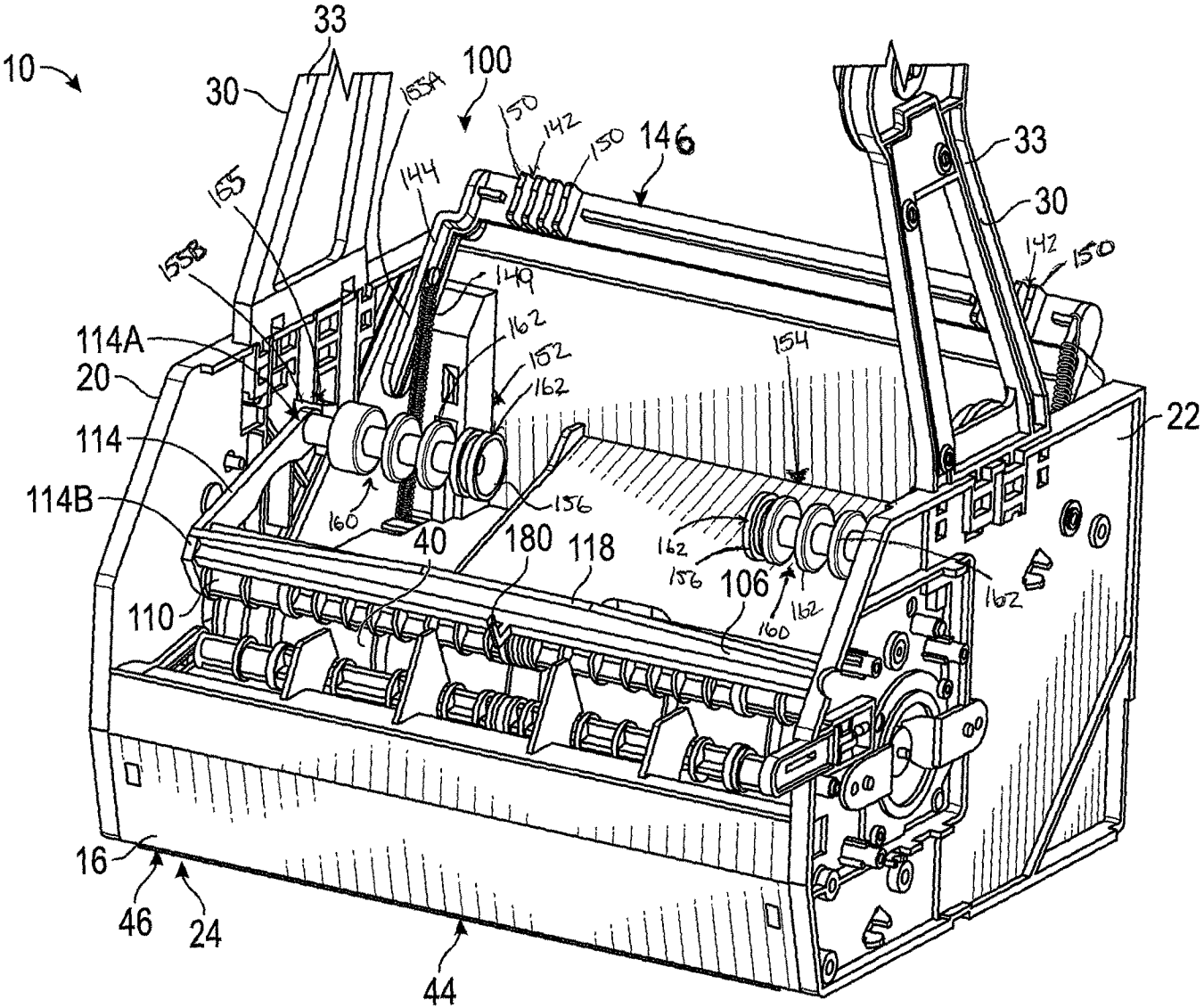

In an alternative embodiment shown in FIGS. 3-4, 6, and 12A-B, the first guide roller assembly 108 can include a plurality of rollers, e.g., two or more guide rollers 152/154. Each guide roller 152/154 of the plurality of rollers can be connected to the first end 114A/116A of the side supports 114/116, such that the guide rollers 152/154 are substantially coaxial and spaced apart from each other. Each roller 152/154 further can have a body 156 with a plurality of spaced projections 158. FIGS. 3-4 and 6 show that each body 156 can include a pair of projections 158 that define a notch or groove 160 therebetween, though as shown in FIGS. 12A and 12B, each body 156 can have more than two projection portions 158, e.g., 4 or more projection portions that are spaced therealong. The portions 158 generally are sized, or otherwise configured to be received within one or more corresponding notches or grooves 142 defined along the arm 146, which is arranged along or substantially adjacent the guide rollers 152/154. The projections 158 further can have a circumferential or annular surface 162 configured to at least partially contact or engage the sheet material 27 as it is fed from the first supply roll 26.

According to embodiments of the present disclosure, the body 152 (or bodies 156) of the guide roller(s) can be formed from plastic materials, such as acrylonitrile buedione styrene ("ABS") plastic or other suitable plastics or polymeric materials, though the body 152 (or bodies 156) of the guide rollers can be formed from any suitable material, such as a metallic material, e.g., aluminum, stainless steel, etc., with a rubber and/or an anti-static plastic disposed thereabout, though any suitable materials, e.g., wood or other composite or synthetic materials, or combinations thereof can be employed without departing from the scope of the present disclosure.

Figure 10A:
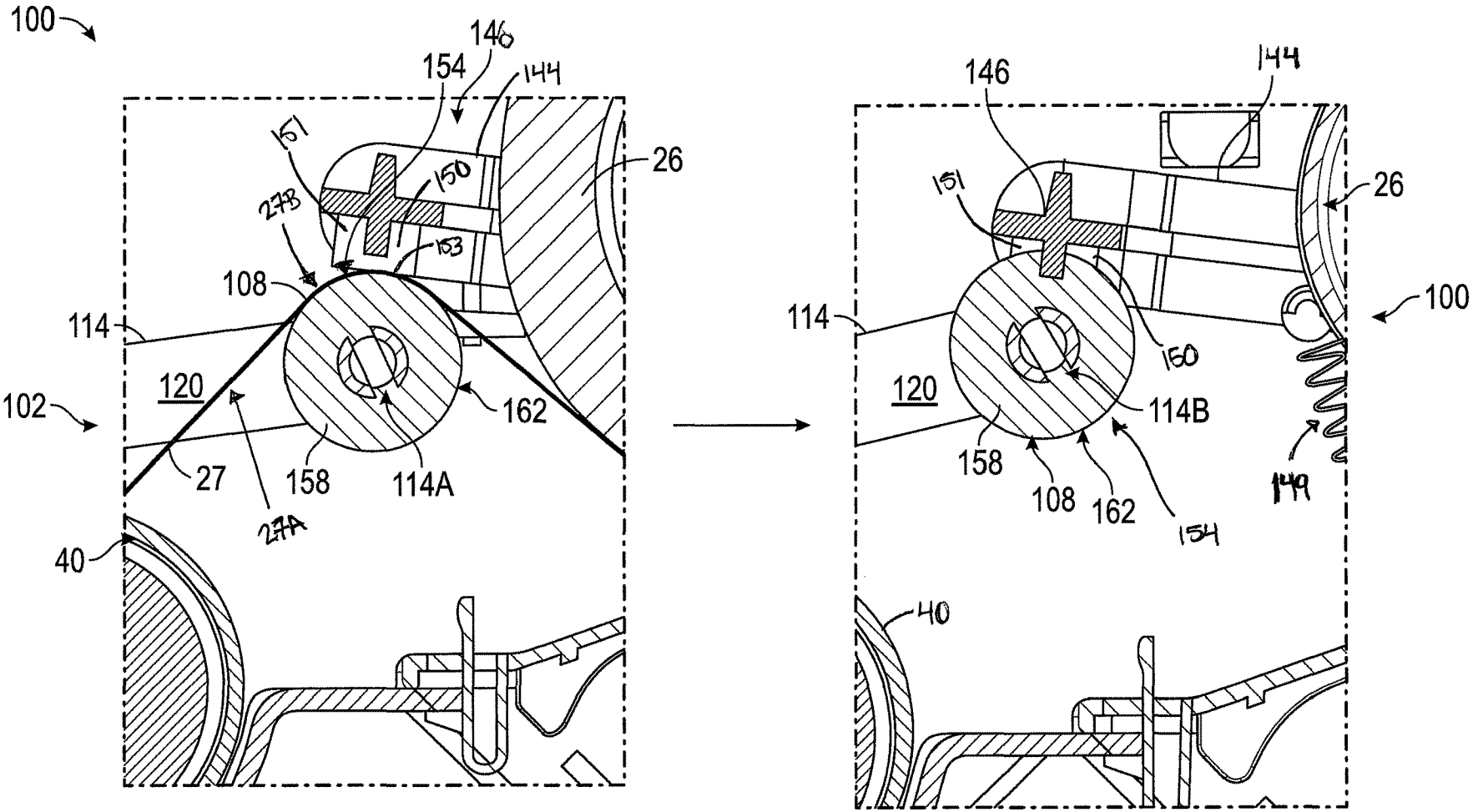
FIGS. 10A-10B are cross-sectional views illustrating operation of the first guide roller assembly according to one aspect of the present disclosure.
Figure 10B:
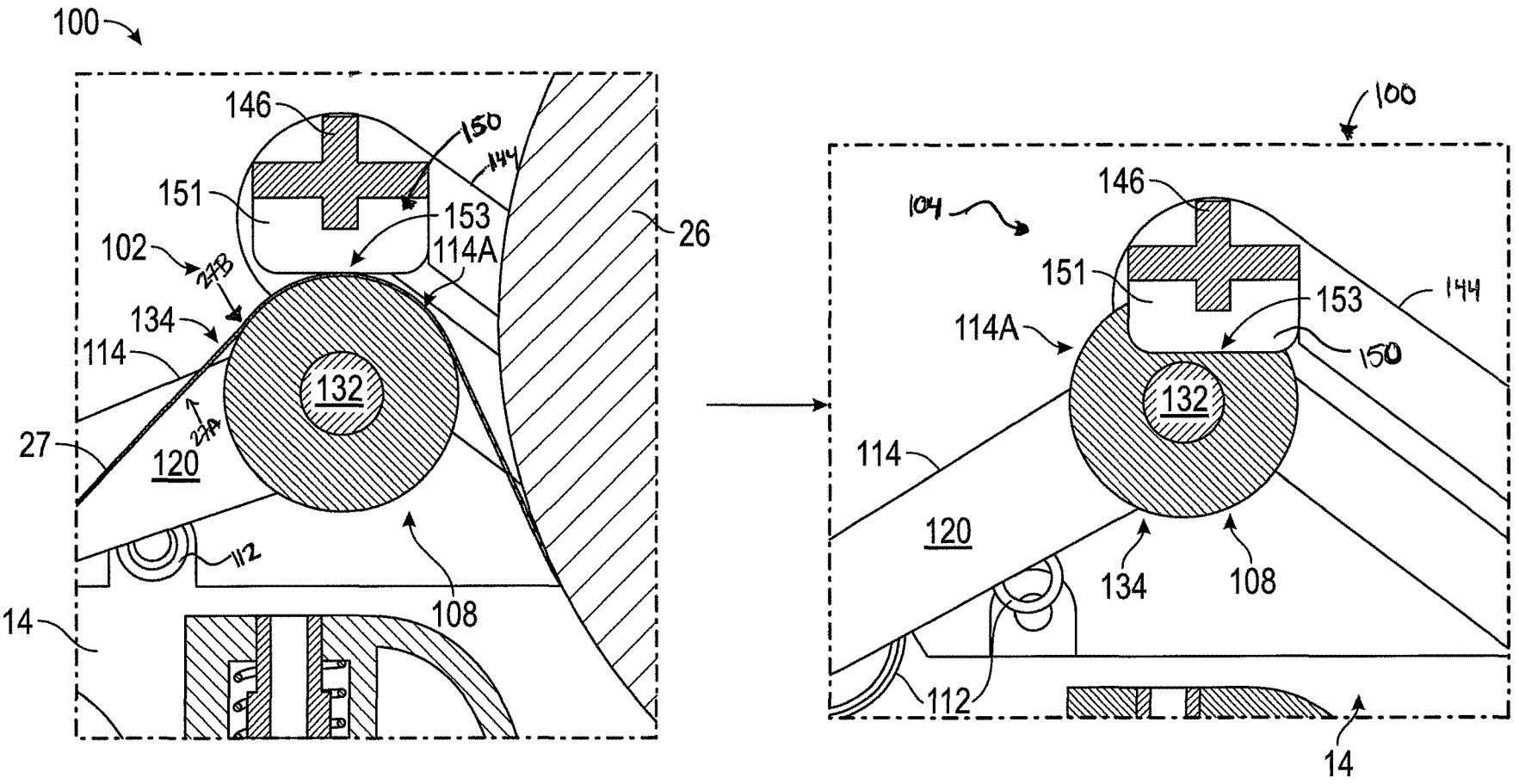
Figure 11A:
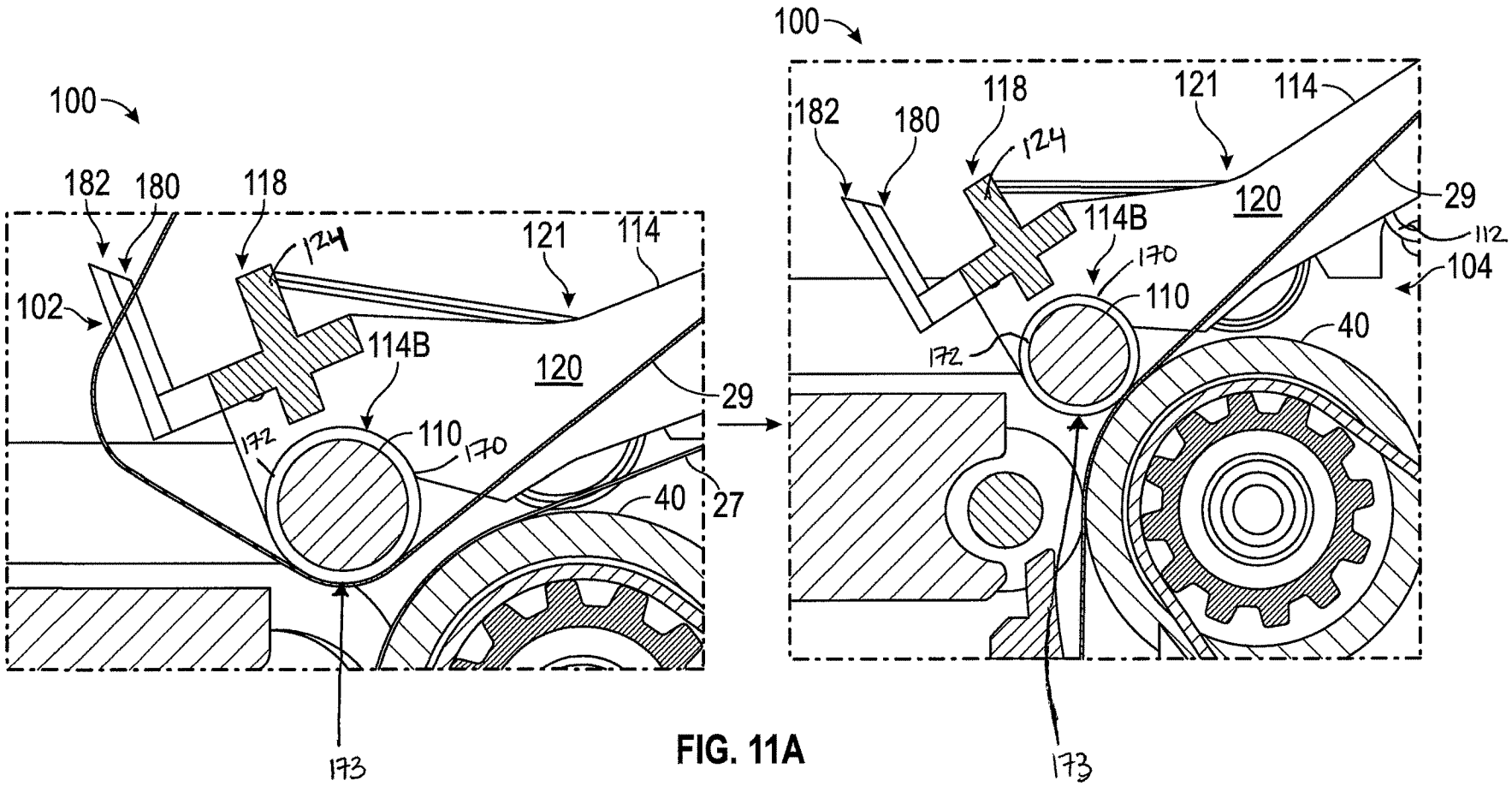
FIGS. 11A-11B are cross-sectional views illustrating operation of the second guide roller assembly according to one aspect of the present disclosure.
Figure 11B:
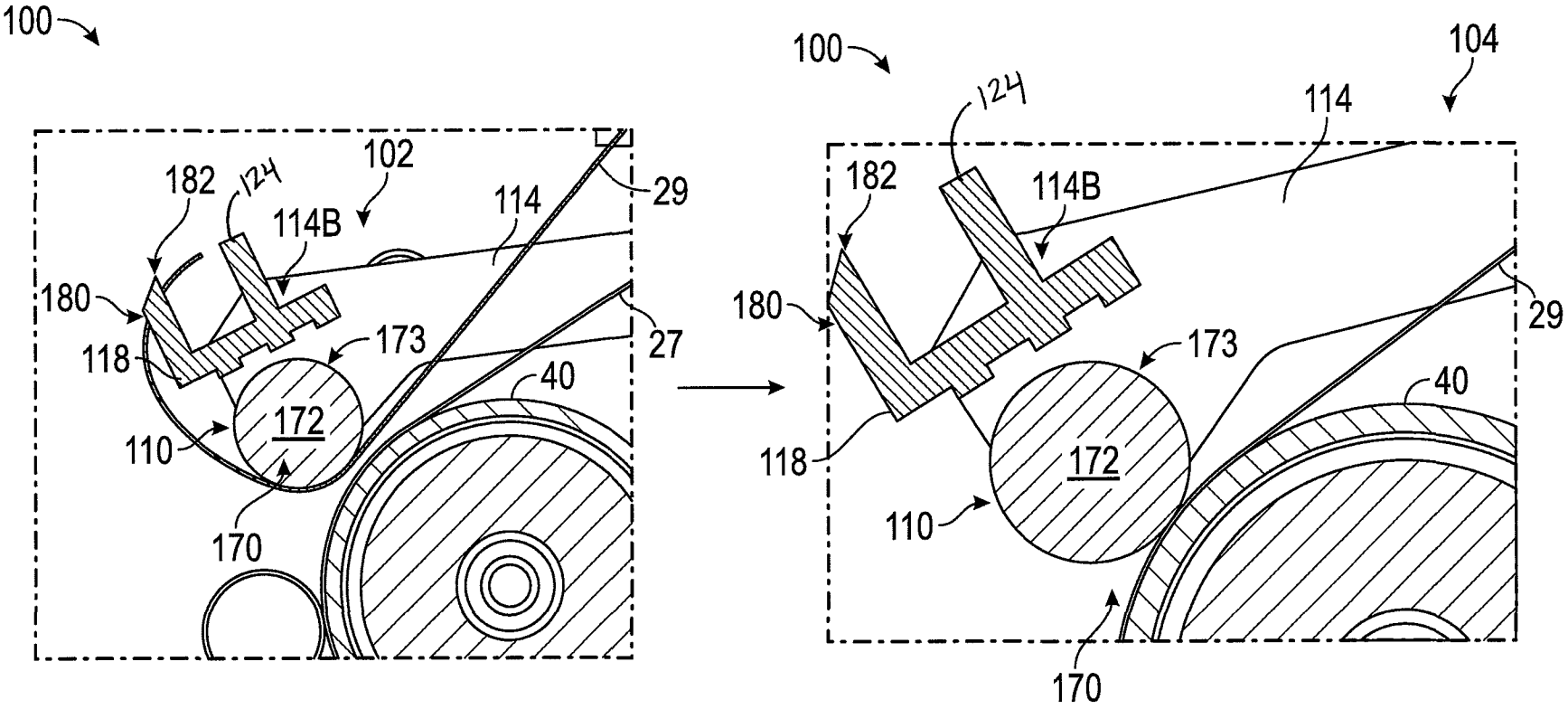

Additionally, as shown in FIGS. 3, 5, 7, and 10A-B, with the transfer assembly 100 in its first position 102, sheet material 27 from the first supply roll 26 will be fed between the guide roller 130 (or the pair of spaced apart, coaxial rollers 152/154) of the first guide roller assembly 108 and the support arm 146 adjacent the first guide roller assembly 108 such that the surfaces 138 of the guide roller 130 (or surfaces 162 of the guide roller 152/154) and the surfaces 153 of the portions 150 of the support arm 146 at least partially contact or engage the sheet material 27 fed/dispensed from the first supply roll 26. For example, the surfaces 130/162 of the guide roller(s) may contact a lower surface 27A of the fed sheet material 26 and the surfaces 153 of portions 130 may contact an upper surface 27B of the fed sheet material 27 (FIG. 10A). The sheet material 27 further can be fed into contact or engagement with the feed roller 40 such that the feed roller 40 can facilitate feeding of the sheet material 27 from the first supply roll 26 through the discharge throat/chute 44 upon rotation/movement thereof.

The frame 106, which is generally biased by the biasing member 112 toward the second position 104, further presses or otherwise engages the sheet material 27 between the guide roller 130 and the member 146 as the sheet material 27 is fed in the first position 102; however, when sheet material 27 runs out or is substantially fully dispensed and is absent from between the guide roller 130 and the support arm 146, the biased frame 106 will pivot, rotate or otherwise move, such that the projecting portions 134/150 of the roller 130 and support arm 146 are at least partially received within the corresponding notches 142/136 of the support arm 146 and roller 130 in an intermeshing or interlinking arrangement.

The mechanical stop features 155 further can stop rotation or movement of the support arm 146 past a prescribed position, such that when the projections 134/150 are intermeshed or interlinked, the frame 106 is allowed to rotate a sufficient amount to move to its second position 104, i.e., such that second roller assembly can engage the second supply 29 of the sheet material against the feed roller 40. In one embodiment, the surfaces/portions 155B that are positioned along the dispenser housing will engage at least a portion (155A) of the member 146 or a portion attached thereto to stop or prevent the member 146 from further engaging the frame 106 to its first position 102, when the second supply of sheet material 27 is exhausted and no longer between the member 146 and guide roller 130, so as to allow the frame 106 to rotate towards and to the second position 104, e.g., under force of the biasing member(s) 112.

As generally illustrated in FIGS. 5-6, 8, 9A-9B, and 11A-B, the second roller assembly 110 can include a guide roller 170 that is configured to at least partially engage the sheet material 29 fed/dispensed from the second supply roll 28. The guide roller 170 generally includes a body 172 that has a generally cylindrical shape, and a circumferential surface for at least partially engaging sheet material 29 dispensed from the second supply roll 28. The body 172 further can have a series of annular notches or grooves 174 defined therein. The body 172 further can be rotatably coupled to the second end 114A/114B of the supports at its ends 172A/172B.

The body 172 of the guide roller 170 can be formed from a plastic material, e.g., ABS plastic or other suitable plastic or polymeric material; or a metallic material (e.g., aluminum, stainless steel, etc.) with a rubber or anti-static plastic disposed therealong though the body 172. The guide roller 170 can be formed from any suitable materials, such as wood, synthetics, composites, etc., however, without departing from the scope of the present disclosure. The guide rollers 130 and 170 can generally be formed from the same materials, though the rollers can be formed from different materials without departing from the scope of the present disclosure.

With the sheet material transfer system 100 in its first position/configuration 102, at least a portion of the sheet material 29 from the second supply roll 28 of sheet material can be at least partially received about the guide roller 170 of the second roller assembly 110. For example, the sheet material 29 can be substantially wrapped around and held in place about the circumferential surface 173 of the guide roller 170. Further, in one embodiment, at least a portion of the sheet material 29 can be engaged by one or more projecting portions 180 arranged along the support 118. For example, the one or more projecting portions 180 can have a portion or edge 182 that at least partially penetrates or otherwise engages the sheet material 29 to hold the sheet material 29 along the guide roller 170.

Figure 2A:
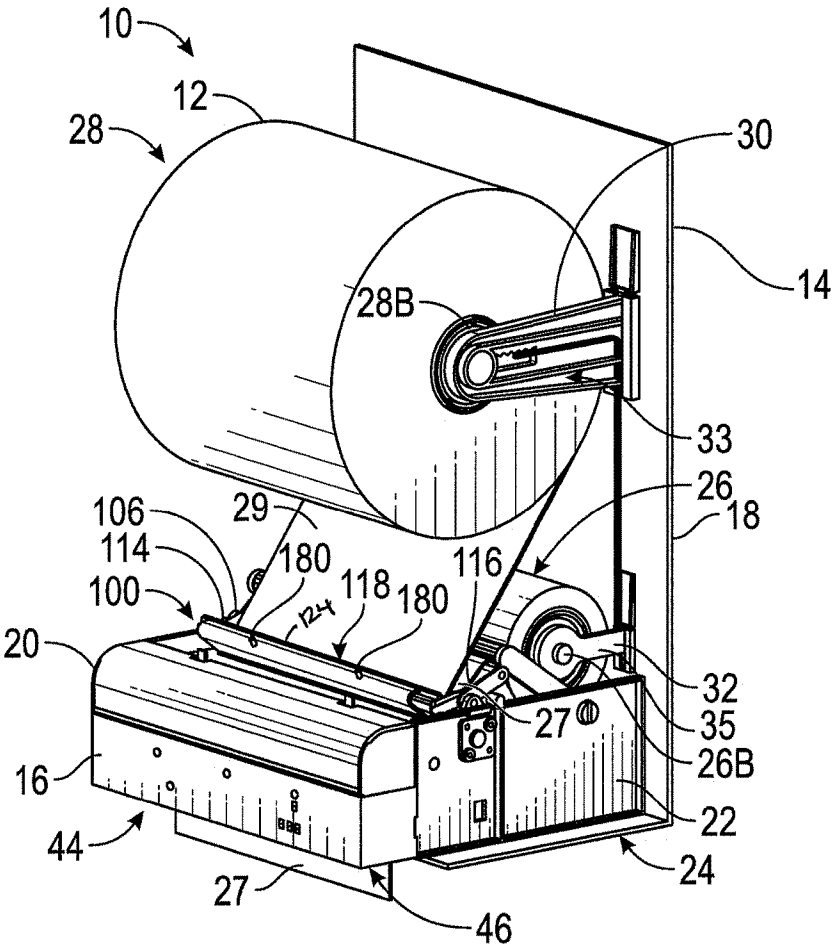

As shown in FIGS. 1A-1B and 3-4, the support 118 may have one projecting portion 180 arranged generally at a midpoint therealong; however, as shown in FIGS. 2A-2B and 7, a plurality of projection portions 180, for example, two (or more) projecting portions 180, can be arranged along the support 118. It will, however, be understood that any suitable number of projecting portions or other mechanisms for holding/maintaining the sheet material 29 substantially in position about the guide roller 170 can be employed without departing from the scope of the present disclosure. Further, with the sheet material transfer assembly 100 in the first position 102, the guide roller 170 can be spaced apart from the feed roller 40 to allow for feeding or drawing of the sheet material 27 from the first supply roll 26.

Accordingly, with the transfer assembly 100 in the first position 102, sheet material 27 can be fed from the first supply roll 26 through the presses arrangement of the guide roller 130 and support 146 into engagement with the feed roller 40 such that activation and/or rotation thereof draws the sheet material from its supply roll 26 and dispenses the sheet material 27 along a dispensing path through and out of the opening 46 of the discharge chute 44 (FIGS. 1B, 2B, 3, 7, 9A, and 10A-D). Additionally, in the first position 102, the guide roller 170 of the second roller assembly 110, with the sheet material 27 from the second supply roll 28 at least partially received thereabout, generally will be spaced away and apart from the feed roller 40. For example, with the sheet material 27 engaged therebetween, the biasing member 149 may urge the frame 106 towards the first position 102 such that the guide roller 170 is substantially spaced apart from the feed roller 40, i.e., the biasing force of biasing member 149 will generally overcome the biasing force of the biasing member 112 to urge the frame 106 towards and/or to the first position 102.

When the sheet material 27 of the first supply roll 26 has been substantially fully dispensed, the projecting sections 134 of the first roller assembly 108 will be enabled to at least partially received within the notches 142 of the member 146, allowing the frame 106 to rotate, pivot, or otherwise move under force or tension of the biasing member 112 toward its second position 104 (FIGS. 4, 6, 8, and 10A-10D). FIG. 8 further shows that the projecting portions 134/150 of the roller 130 and member 146 generally are at least partially received within the corresponding notches 142/136 of the member 146 and roller 130 in an intermeshing or interlocking arrangement as the frame 106 rotates, pivots, or otherwise moves towards the second position 104.

As generally shown in FIGS. 6, 9B, and 11A-B, the frame 106 generally will rotate and/or move a sufficient amount or distance such that the second roller assembly 110, with the portion of sheet material 29 disposed thereabout, is moved into engagement with the feed roller 40 to an extent so as to facilitate transfer of active feeding or dispensing of sheet material between the first and second supply rolls 26/28. For example, when the frame 106 has shifted/moved to the second position 104, the sheet material 29 can be pressed toward or otherwise engaged by the guide roller 170 against the feed roller 40, and upon activation of the feed roller 40, the feed roller 40 will at least partially engage and/or pull the sheet material 29 to feed the sheet material 29 toward and out from the discharge chute/throat 44 for dispensing thereof. Initially, with the transfer system frame 106 in the second position 104, the feed roller 40 will contact or engage the portion of the sheet material 29 disposed about the guide roller 170 and, as it rotates, will separate or disengage the sheet material 29 from the projecting portion 180, and thereafter feed the sheet material 29 along the discharge path toward and out of the discharge chute 44 of the dispenser assembly. Accordingly, transfer of the active feeding/dispensing of sheet material between the first and second supply rolls 26/28 can be affected when/if the first supply roll 26 has been exhausted/fully dispensed. Further, the mechanical stop features 155 in communication with the side supports 144 supporting the support arm 146 will prevent the support arm 146 from continuing to rotate the frame 106 towards the first position 102, after the sheet material is fully dispensed and the projecting portions 134/150 are received within the corresponding notches 142/136.

In addition, movement of the frame 106 from the first portion 102 to the second position 104 can activate a notification mechanism (e.g., an LED, light bulb or other indicator displayed along the housing of the dispenser) or otherwise trigger an alarm to indicate that the first supply roll 26 (e.g., the stub roll) has been fully dispensed.

Accordingly, with embodiments of the present disclosure, an operator can load the first and second supply rolls 26/28 into the dispenser assembly onto support arms 35 and 33, respectively. For example, the first supply 26 can include a "stub roll" that includes a supply roll that has been at least partially dispensed and the second supply 28 can include a new or full roll of sheet material. Upon loading of the supply rolls 26/28, the sheet material 27 from the first supply 26 can be fed through the projecting portions 134/150 of the roller 130 and member 146 into engagement with the feed roller 40, such that the frame 106 is in its first position 102 and the first supply ("stub roll") is ready for active dispensing. With the sheet material received between the portions 134/150, the biased member 146 further may engage the biased frame 106 towards the first position 102.

After the first supply 26 of sheet material is completely exhausted, the absence of sheet material between portions 134/150 will allow portions 134/150 to interlink/intermesh, thereby allowing the frame 106 to move towards its second position 104 (e.g., under force or tension of biasing member 112), wherein the roller 170 engages the sheet material from the second supply of sheet material against the feed roller 40 to allow for dispensing thereof. The mechanical stop features 155 can prevent/stop movement of the biased support arm 146 to allow the frame 106 to be moved to the second position 104 by the biasing member 112. As a result, the transfer assembly 100 can provide a generally automatic transfer of active dispensing of the sheet material to the second supply 28 of sheet material once the first supply 26 is fully exhausted without necessarily requiring manual sheet material or sheet material path manipulation.

The foregoing description generally illustrates and describes various embodiments of this disclosure. It will, however, be understood by those skilled in the art that various changes and modifications can be made to the above-discussed constructions and systems without departing from the spirit and scope of this disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of this disclosure. Accordingly, various features and characteristics as discussed herein may be selectively interchanged and applied to other illustrated and non-illustrated embodiment, and numerous variations, modifications, and additions further can be made thereto without departing from the spirit and scope of the present invention as set forth in the appended claims.

What is claimed is:

1. A dispenser assembly for dispensing a sheet material, comprising:

a housing comprising a discharge, and a plurality of supply rolls of sheet material rotatably mounted therealong;

a feed roller rotatably mounted along the housing and operable to facilitate dispensing of the sheet material from the plurality of supply rolls of sheet material along a discharge path toward and through the discharge of the housing; and a sheet material transfer assembly adjacent the feed roller in a position for selectively directing sheet materials from the plurality of supply rolls of sheet material into engagement with the feed roller to transfer feeding of sheet material between the plurality of supply rolls of sheet material, the sheet material transfer assembly including a frame that is movable between a plurality of positions including a first position that facilitates feeding or dispensing of the sheet material from a first supply of sheet material, and a second position that facilitates feeding or dispensing of sheet material from a second supply of sheet material;

wherein the frame of the sheet material transfer assembly moves to the second position for dispensing sheet material from the second supply of sheet material when the first supply of sheet material is substantially fully dispensed, and includes a plurality of roller assemblies coupled thereto, the plurality of roller assemblies comprising a first roller assembly having at least one roller that at least partially engages sheet material from the first supply roll of sheet material, and a second roller assembly having at least one roller that at least partially engages sheet material from the second supply roll of sheet material.

2. The dispenser assembly of claim 1, further comprising a support arm positioned adjacent the first roller assembly and comprising a plurality of grooves defined therein, wherein the at least one roller of the first roller assembly comprises a series of spaced projections each having an annular surface that at least partially engages the sheet material from the first supply roll of sheet material, and wherein when the first supply roll of sheet material is substantially fully dispensed, the series of spaced projections are received within corresponding grooves of the plurality of grooves of the support arm positioned adjacent the first roller assembly as the frame rotates to the second position for dispensing of the second supply of sheet material.

3. The dispenser assembly of claim 2, wherein the support arm comprises a series of spaced portions therealong that at least partially define the plurality of grooves therealong, wherein the series of spaced portions each comprise a surface that at least partially engages the sheet material from the first supply of sheet material so that at least a portion of the first supply of sheet material is engaged between the series of spaced portions of the support arm and the series of spaced projections of the first roller assembly with the frame in the first position.

4. The dispenser assembly of claim 2, wherein when the first supply of sheet material is fully dispensed, the series of spaced portions of the support arm interlock or intermesh with the series of spaced projections of the first roller assembly as the frame is moved to the second position.

5. The dispenser assembly of claim 2, further comprising one or more biasing members in communication with a support arm to urge the support arm into engagement with the frame to urge the frame towards the first position.

6. The dispenser assembly of claim 2, further comprising one or more mechanical stops in communication with the support arm that prevent a movement of the support arm in at least one direction and allow the frame to move toward the second position when the first supply of sheet material has been substantially fully dispensed.

7. The dispenser assembly of claim 1, wherein the frame further comprises projecting portions arranged along the frame so as to hold the sheet material of the second supply of sheet material about the at least one roller of the second roller assembly with the frame in the first position.

8. The dispenser assembly of claim 7, wherein the one or more projecting portions arranged along the frame comprise at least one sharpened edge.

9. The dispenser assembly of claim 1, further comprising one or more biasing members coupled to the frame to urge the frame toward the second position for dispensing the second supply of sheet material when the first supply is substantially fully dispensed.

10. A dispenser, comprising:

a housing comprising a discharge;

a plurality of supplies of sheet material supported along the housing, the plurality of supplies of sheet material comprising a first supply of sheet material and a second supply of sheet material;

a feed roller rotatably mounted along the housing and operable to facilitate dispensing of the sheet material from the plurality of supplies of sheet material along a feed path that extends through the discharge; and a sheet material transfer assembly operable to automatically transfer active dispensing between the plurality of supplies of sheet material, the sheet material transfer assembly comprising:

a frame that is movable between a plurality of positions including a first position that facilitates dispensing sheet material from the first supply of sheet material, and a second position that facilitates dispensing sheet material from the second supply of sheet material; and a plurality of guide roller assemblies coupled to the frame, including a first guide roller assembly that engages sheet material from the first supply of sheet material, and a second guide roller assembly that engages sheet material from a second supply of sheet material, wherein the sheet material from the second supply of sheet material is received about the second guide roller assembly, and the second guide roller assembly, with the second supply of sheet material received thereabout, is spaced apart from the feed roller when the frame is in the first position, and wherein when the first supply of sheet material is substantially fully dispensed, the frame is moved to its second position, wherein the second guide roller assembly moves the sheet material from the second supply at least partially against the feed roller for dispensing of the sheet material from the second supply of sheet material.

11. The dispenser of claim 10, further comprising at least one support arm having a series of spaced portions positioned therealong that is movably mounted to the housing so as to be arranged substantially adjacent to the second guide roller assembly, wherein the first guide roller assembly comprises a series of spaced projections, and wherein at least a portion of the sheet material from the first supply of sheet material is engaged between series of spaced portions of the least one support arm and the series of spaced projections of the first guide roller assembly with the frame in the first position.

12. The dispenser of claim 11, wherein when the first supply of sheet material is fully dispensed, the series of spaced portions of the at least one member interlock or intermesh with the series of spaced projections of the first guide roller assembly as the frame is moved to the second position.

13. The dispenser of claim 11, wherein the at least one member is biased by one or more biasing members to engage and urge the frame towards the first position with the at least a portion of the first supply of sheet material engaged between the series of spaced portions of the at least one member and the series of spaced projections of the first guide roller assembly, and wherein the at least one member is in communication with one or more mechanical stops that prevent a movement of the member and allow the frame to move toward the second position when the first supply of sheet material has been fully dispensed.

14. A dispenser assembly for dispensing a sheet material, comprising:

a housing supporting a plurality of supply rolls of sheet material including a first supply of sheet material and a second supply of sheet material rotatably mounted along the housing, the housing including a discharge for dispensing of sheet material from the first supply or second supply;

a feed roller rotatably mounted along the housing and operable to facilitate dispensing of the sheet material from the first supply or the second supply along a discharge path toward and through the discharge of the housing; and a sheet material transfer assembly that is movable between a plurality of configuration including a first configuration that facilitates dispensing of the sheet material from the first supply, and a second configuration that facilitates dispensing of the sheet material from the second supply, the sheet material transfer assembly including:

a plurality of rollers including a first roller configured to at least partially engage the sheet material from the first supply, and a second roller configured to at least partially engage the sheet material from the second supply and that is spaced away from the feed roller when the sheet material transfer assembly is in the first configuration; and a support positioned adjacent the first roller such that the sheet material from the first supply is at least partially engaged between the support and the first roller, with the sheet material transfer assembly in the first configuration, and configured to intermesh or interlink with the first roller when the sheet material from the first supply of sheet material is exhausted to facilitate movement of the sheet material transfer assembly to the second configuration and bring the second roller towards the feed roller to engage at least a portion of the sheet material from the second supply against the feed roller for dispensing thereof.

15. The dispenser assembly of claim 14, wherein the sheet material transfer assembly further includes a movable frame connected to the first roller and the second roller.

16. The dispenser assembly of claim 15, wherein the frame includes one or more engagement portions arranged therealong and configured to hold the sheet material from the second supply of sheet material about the second roller with the sheet material transfer assembly in the first configuration.

17. The dispenser assembly of claim 15, wherein the sheet material transfer assembly further includes one or more biasing members in communication with the frame to urge the second roller toward engagement with the feed roller.

18. The dispenser assembly of claim 14, wherein the sheet material transfer assembly further includes one or more biasing members in communication with the support to urge the support toward engagement with the first roller and to help to hold the sheet material transfer assembly in the first configuration.

19. The dispenser assembly of claim 14, wherein the support includes a plurality of spaced portions arranged therealong that at least partially define a plurality of grooves therebetween and each have a surface that at least partially engages the sheet material from the first supply, wherein the first roller has a plurality of spaced projections each having an annular surface that at least partially engages the sheet material from the first supply, and wherein when the first supply roll of sheet material is substantially fully dispensed, the spaced projections of the first roller are received within corresponding grooves of the plurality of grooves of the support.

20. The dispenser assembly of claim 14, wherein the sheet material transfer assembly further includes one or more mechanical stops configured to prevent a movement of the support in at least one direction.

* * * * *